US010001716B2

(12) United States Patent
Shimizu et al.

(10) Patent No.: US 10,001,716 B2
(45) Date of Patent: Jun. 19, 2018

(54) POSITIVELY CHARGEABLE SINGLE-LAYER ELECTROPHOTOGRAPHIC PHOTOSENSITIVE MEMBER, PROCESS CARTRIDGE, AND IMAGE FORMING APPARATUS

(71) Applicant: KYOCERA Document Solutions Inc., Osaka (JP)

(72) Inventors: Tomofumi Shimizu, Osaka (JP); Makoto Shishido, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days. days.

(21) Appl. No.: 15/077,144

(22) Filed: Mar. 22, 2016

(65) Prior Publication Data

US 2016/0282732 A1 Sep. 29, 2016

(30) Foreign Application Priority Data

Mar. 24, 2015 (JP) ..... 2015-060603

(51) Int. Cl.
*G03G 5/06* (2006.01)

(52) U.S. Cl.
CPC ..... *G03G 5/0614* (2013.01); *G03G 5/0609* (2013.01); *G03G 5/0612* (2013.01); *G03G 5/0616* (2013.01); *G03G 5/0631* (2013.01); *G03G 5/0651* (2013.01)

(58) Field of Classification Search
CPC .. G03G 5/0696; G03G 5/0609; G03G 5/0631; G03G 5/0614
See application file for complete search history.

(56) References Cited

U.S. PATENT DOCUMENTS

| | | | | | |
|---|---|---|---|---|---|
| 6,127,076 | A * | 10/2000 | Ishigami | ..... | C07D 471/06 430/58.5 |
| 6,593,047 | B2 * | 7/2003 | Azuma | ..... | G03G 5/0564 430/56 |
| 7,195,851 | B2 * | 3/2007 | Kiuchi | ..... | C07D 231/22 430/58.55 |
| 2006/0183044 | A1 * | 8/2006 | Kim | ..... | C07D 471/06 430/78 |
| 2017/0146916 | A1 * | 5/2017 | Takeuchi | ..... | G03G 5/0631 |

FOREIGN PATENT DOCUMENTS

| | | | | | |
|---|---|---|---|---|---|
| JP | 2000226354 | A | * | 8/2000 | |
| JP | 2003098701 | A | * | 4/2003 | |
| JP | 2006-184527 | A | | 7/2006 | |
| JP | 2012208232 | A | * | 10/2012 | |
| JP | 2013079991 | A | * | 5/2013 | |
| JP | 2015094839 | A | * | 5/2015 | |
| WO | WO-2017072972 | A1 | * | 5/2017 | ..... G03G 5/05 |

OTHER PUBLICATIONS

English language machine translation of JP 2000-226354 (Aug. 2000).*

(Continued)

*Primary Examiner* — Christopher D Rodee
(74) *Attorney, Agent, or Firm* — Studebaker & Brackett PC

(57) ABSTRACT

A positively chargeable single-layer electrophotographic photosensitive member includes a conductive substrate and a photosensitive layer. The photosensitive layer contains at least a charge generating material, a hole transport material, an electron transport material, and an electron accepting compound. The hole transport material includes a benzidine derivative. The electron transport material includes at least one compound selected from the group consisting of compounds represented by general formulae (1), (2), (3), and (4) shown below. The electron accepting compound includes at (Continued)

least one compound selected from the group consisting of compounds represented by general formulae (5) and (6) shown below.

(1)

(2)

(3)

(4)

-continued (5)

(6)

9 Claims, 4 Drawing Sheets

(56) References Cited

OTHER PUBLICATIONS

Springett, B., Handbook of Imaging Materials; Diamond, A., Ed.; Marcel-Dekker, Inc.: New York 2002; pp. 145-164.*
Borsenberger, P.M.; Weiss, D.S. Handbook of Imaging Materials; Diamond, A., Ed.; Marcel-Dekker, Inc.: New York 2002; pp. 369, 376, 401-409.*
English language machine translation of WO 2017/072972 (May 2017).*

* cited by examiner

POSITIVELY CHARGEABLE SINGLE-LAYER ELECTROPHOTOGRAPHIC PHOTOSENSITIVE MEMBER, PROCESS CARTRIDGE, AND IMAGE FORMING APPARATUS

INCORPORATION BY REFERENCE

The present application claims priority under 35 U.S.C. § 119 to Japanese Patent Application No. 2015-060603, filed on Mar. 24, 2015. The contents of this application are incorporated herein by reference in their entirety.

BACKGROUND

The present disclosure relates to a positively chargeable single-layer electrophotographic photosensitive member, a process cartridge, and an image forming apparatus.

Electrophotographic photosensitive members are used in electrophotographic image forming apparatuses. A generic electrophotographic photosensitive member includes a photosensitive layer. The photosensitive layer may contain a charge generating material, a charge transport material (for example, a hole transport material or an electron transport material), and a resin that binds the aforementioned materials (binder resin). The photosensitive layer may be one in which a single layer contains the charge transport material and the charge generating material, and thus in which the one layer implements both a charge generation function and a charge transport function. An electrophotographic photosensitive member including such a photosensitive layer is referred to as a single-layer electrophotographic photosensitive member.

An electrophotographic photosensitive member known as the above-described photosensitive member contains a benzoquinone derivative.

SUMMARY

A positively chargeable single-layer electrophotographic photosensitive member according to the present disclosure includes a conductive substrate and a photosensitive layer. The photosensitive layer contains at least a charge generating material, a hole transport material, an electron transport material, and an electron accepting compound. The hole transport material includes a benzidine derivative. The electron transport material includes at least one compound selected from the group consisting of compounds represented by general formulae (1), (2), (3), and (4). The electron accepting compound includes at least one compound selected from the group consisting of compounds represented by general formulae (5) and (6).

(1)

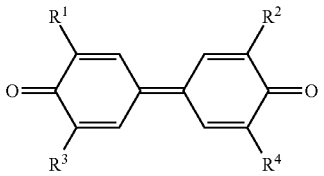

-continued (2)

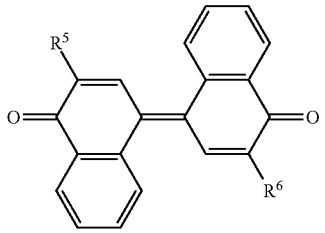

(3)

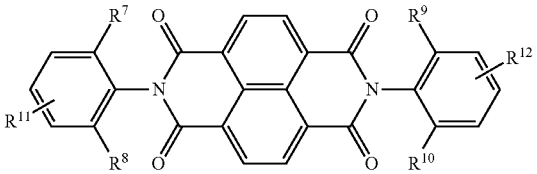

(4)

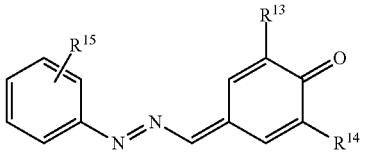

In the general formulae (1) to (4), $R^1$ to $R^{14}$ each represent, independently of one another, a hydrogen atom, an optionally substituted alkyl group, an optionally substituted alkenyl group, an optionally substituted alkoxy group, an optionally substituted aralkyl group, an optionally substituted aromatic hydrocarbon group, or an optionally substituted heterocyclic group. $R^{15}$ represents a halogen atom, a hydrogen atom, an optionally substituted alkyl group, an optionally substituted alkenyl group, an optionally substituted alkoxy group, an optionally substituted aralkyl group, an optionally substituted aromatic hydrocarbon group, or an optionally substituted heterocyclic group.

(5)

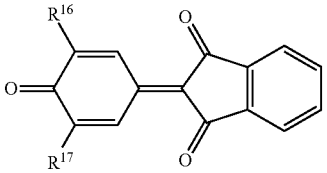

In the general formula (5), $R^{16}$ and $R^{17}$ each represent, independently of one another, a halogen atom, a hydrogen atom, an optionally substituted alkyl group, an optionally substituted alkenyl group, an optionally substituted alkoxy group, an optionally substituted aralkyl group, an optionally substituted aromatic hydrocarbon group, an optionally substituted heterocyclic group, a cyano group, a nitro group, a hydroxyl group, a carboxyl group, an optionally substituted amino group, an optionally substituted acyl group, or an optionally substituted alkynyl group.

(6)

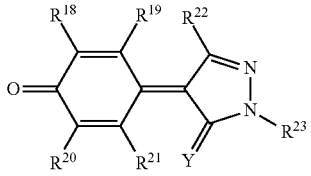

In the general formula (6), $R^{18}$ to $R^{23}$ each represent, independently of one another, a halogen atom, a hydrogen atom, an optionally substituted alkyl group, an optionally substituted alkenyl group, an optionally substituted alkoxy group, an optionally substituted aralkyl group, an optionally substituted aromatic hydrocarbon group, an optionally substituted heterocyclic group, a cyano group, a nitro group, a hydroxyl group, a carboxyl group, an optionally substituted amino group, an optionally substituted acyl group, or an optionally substituted alkynyl group. X represents an oxygen atom, a sulfur atom, or $=C(CN)_2$. Y represents an oxygen atom or a sulfur atom.

A process cartridge according to the present disclosure includes the above-described positively chargeable single-layer electrophotographic photosensitive member.

An image forming apparatus according to the present disclosure includes an image bearing member, a charging section, a light exposure section, a developing section, and a transfer section. The image bearing member is the above-described positively chargeable single-layer electrophotographic photosensitive member. The charging section charges a surface of the image bearing member. The charging section has a positive charging polarity. The light exposure section exposes the surface of the image bearing member in a charged state to light to form an electrostatic latent image on the surface of the image bearing member. The developing section develops the electrostatic latent image into a toner image. The transfer section transfers the toner image from the image bearing member to a transfer target.

DETAILED DESCRIPTION

Figure 1A:
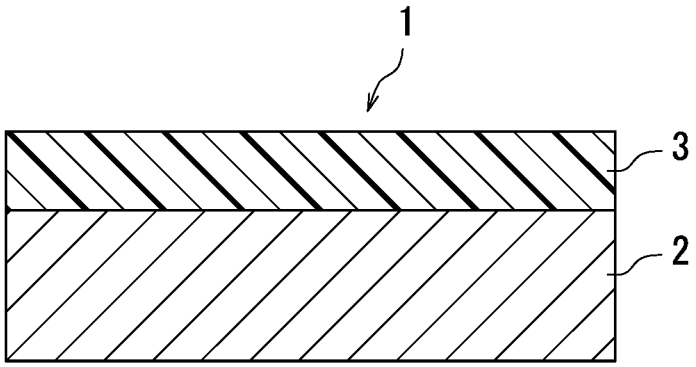
FIGS. 1A, 1B, and 1C are schematic cross-sectional views each illustrating a structure of a positively chargeable single-layer electrophotographic photosensitive member according to a first embodiment.

The following describes embodiments of the present disclosure in detail. The present disclosure is not in any way limited by the following embodiments. Appropriate changes may be made when practicing the present disclosure so long as such changes do not deviate from the intended scope of the present disclosure. Note that although description may be omitted in some places in order to avoid repetition, such omission does not limit the essence of the present disclosure.

Also note that in the present description the term "-based" may be appended to the name of a chemical compound in order to form a generic name encompassing both the chemical compound itself and derivatives thereof. Also, when the term "-based" is appended to the name of a chemical compound used in the name of a polymer, the term indicates that a repeating unit of the polymer originates from the chemical compound or a derivative thereof.

Hereinafter, an alkyl group having a carbon number of no less than 1 and no greater than 10, an alkyl group having a carbon number of no less than 1 and no greater than 9, an alkyl group having a carbon number of no less than 1 and no greater than 7, an alkyl group having a carbon number of no less than 1 and no greater than 6, an alkyl group having carbon member of no less than 1 and no greater than 5, an alkyl group having a carbon number of no less than 1 and no greater than 4, a cycloalkyl group having a carbon number of no less than 3 and no greater than 10, a cycloalkyl group having a carbon number of no less than 3 and no greater than 9, a cycloalkyl group having a carbon number of no less than 3 and no greater than 7, a cycloalkyl group having a carbon number of no less than 3 and no greater than 6, a cycloalkyl group having a carbon number of no less than 3 and no greater than 5, a cycloalkyl group having a carbon number of no less than 3 and no greater than 4, an alkenyl group having a carbon number of no less than 2 and no greater than 10, an alkenyl group having a carbon number of no less than 2 and no greater than 6, an alkenyl group having a carbon number of no less than 2 and no greater than 4, an alkoxy group having a carbon number of no less than 1 and no greater than 10, an alkoxy group having a carbon number of no less than 1 and no greater than 6, an alkoxy group having a carbon number of no less than 1 and no greater than 4, an aralkyl group having a carbon number of no less than 7 and no greater than 15, an aralkyl group having a carbon number of no less than 7 and no greater than 13, an aralkyl group having a carbon number of no less than 7 and no greater than 12, an aromatic hydrocarbon group having a carbon number of no less than 6 and no greater than 14, an aromatic hydrocarbon group having a carbon number of no less than 6 and no greater than 10, a heterocyclic group, a halogen atom, an aliphatic acyl group having a carbon number of no less than 2 and no greater than 4, an alkoxycarbonyl group having a carbon number of no less than 2 and no greater than 5, an alkynyl group having a carbon number of no less than 2 and no greater than 10, an alkynyl group having a carbon number of no less than 2 and no greater than 6, and an alkynyl group having a carbon number of no less than 2 and no greater than 5 each refer to the following unless otherwise stated.

An alkyl group having a carbon number of no less than 1 and no greater than 10 as used herein refers to an unsubstituted straight chain, branched chain, or ring alkyl group. Examples of the straight chain or branched chain alkyl group having a carbon number of no less than 1 and no greater than 10 include a methyl group, an ethyl group, an n-propyl group, an isopropyl group, an n-butyl group, a sec-butyl group, a tert-butyl group, a pentyl group, a 1-methyl-2-butyl group, an n-hexyl group, an n-heptyl group, an n-octyl group, a 2-ethylhexyl group, an n-nonyl group, and an n-decyl group. Examples of the ring alkyl group include an alkyl group having a carbon number of no less than 3 and no greater than 10.

An alkyl group having a carbon number of no less than 1 and no greater than 9 as used herein refers to an unsubstituted straight chain, branched chain, or ring alkyl group. Examples of the straight chain or branched chain alkyl group having a carbon number of no less than 1 and no greater than 9 include a methyl group, an ethyl group, an n-propyl group, an isopropyl group, an n-butyl group, a sec-butyl group, a tert-butyl group, a pentyl group, a 1-methyl-2-butyl group, an n-hexyl group, an n-heptyl group, an n-octyl group, a 2-ethylhexyl group, and an n-nonyl group. Examples of the ring alkyl group include a cycloalkyl group having a carbon number of no less than 3 and no greater than 9.

An alkyl group having a carbon number of no less than 1 and no greater than 7 as used herein refers to an unsubstituted straight chain, branched chain, or ring alkyl group. Examples of the straight chain or branched chain alkyl group having a carbon number of no less than 1 and no greater than 7 include a methyl group, an ethyl group, an n-propyl group, an isopropyl group, an n-butyl group, a sec-butyl group, a tert-butyl group, a pentyl group, a 1-methyl-2-butyl group, an n-hexyl group, and an n-heptyl group. Examples of the ring alkyl group include a cycloalkyl group having a carbon number of no less than 3 and no greater than 7.

An alkyl group having a carbon number of no less than 1 and no greater than 6 as used herein refers to an unsubstituted straight chain, branched chain, or ring alkyl group. Examples of the straight chain or branched chain alkyl group having a carbon number of no less than 1 and no greater than 6 include a methyl group, an ethyl group, an n-propyl group, an isopropyl group, an n-butyl group, a sec-butyl group, a tert-butyl group, a pentyl group, a 1-methyl-2-butyl group, and an n-hexyl group. Examples of the ring alkyl group include a cycloalkyl group having a carbon number of no less than 3 and no greater than 6.

An alkyl group having a carbon number of no less than 1 and no greater than 5 as used herein refers to an unsubstituted straight chain, branched chain, or ring alkyl group. Examples of the straight chain or branched chain alkyl group having a carbon number of no less than 1 and no greater than 5 include a methyl group, an ethyl group, an n-propyl group, an isopropyl group, an n-butyl group, a sec-butyl group, a tert-butyl group, a pentyl group, and a 1-methyl-2-butyl group. Examples of the ring alkyl group include a cycloalkyl group having a carbon number of no less than 3 and no greater than 5.

An alkyl group having a carbon number of no less than 1 and no greater than 4 as used herein refers to an unsubstituted straight chain, branched chain, or ring alkyl group. Examples of the straight chain or branched chain alkyl group having a carbon number of no less than 1 and no greater than 4 include a methyl group, an ethyl group, an n-propyl group, an isopropyl group, an n-butyl group, a sec-butyl group, and a tert-butyl group. Examples of the ring alkyl group include a cycloalkyl group having a carbon number of no less than 3 and no greater than 4.

A cycloalkyl group having a carbon number of no less than 3 and no greater than 10 as used herein refers to an unsubstituted cycloalkyl group. Examples of the cycloalkyl group having a carbon number of no less than 3 and no greater than 10 include a cyclopropyl group, a cyclobutyl group, a cyclopentyl group, a cyclohexyl group, a cycloheptyl group, a cyclooctyl group, a cyclononyl group, and a cyclodecyl group.

A cycloalkyl group having a carbon number of no less than 3 and no greater than 9 as used herein refers to an unsubstituted cycloalkyl group. Examples of the cycloalkyl group having a carbon number of no less than 3 and no greater than 9 include a cyclopropyl group, a cyclobutyl group, a cyclopentyl group, a cyclohexyl group, a cycloheptyl group, a cyclooctyl group, and a cyclononyl group.

A cycloalkyl group having a carbon number of no less than 3 and no greater than 7 as used herein refers to an unsubstituted cycloalkyl group. Examples of the cycloalkyl group having a carbon number of no less than 3 and no greater than 7 include a cyclopropyl group, a cyclobutyl group, a cyclopentyl group, a cyclohexyl group, and a cycloheptyl group.

A cycloalkyl group having a carbon number of no less than 3 and no greater than 6 as used herein refers to an unsubstituted cycloalkyl group. Examples of the cycloalkyl group having a carbon number of no less than 3 and no greater than 6 include a cyclopropyl group, a cyclobutyl group, a cyclopentyl group, and a cyclohexyl group.

A cycloalkyl group having a carbon number of no less than 3 and no greater than 5 as used herein refers to an unsubstituted cycloalkyl group. Examples of the cycloalkyl group having a carbon number of no less than 3 and no greater than 5 include a cyclopropyl group, a cyclobutyl group, and a cyclopentyl group.

A cycloalkyl group having a carbon number of no less than 3 and no greater than 4 as used herein refers to an unsubstituted cycloalkyl group. Examples of the cycloalkyl group having a carbon number of no less than 3 and no greater than 4 include a cyclopropyl group and a cyclobutyl group.

An alkenyl group having a carbon number of no less than 2 and no greater than 10 as used herein refers to an unsubstituted straight chain or branched chain alkenyl group. Examples of the alkenyl group having a carbon number of no less than 2 and no greater than 10 include an ethenyl group, a propenyl group, a butenyl group, a pentenyl group, a hexenyl group, a heptenyl group, an octenyl group, a nonenyl group, and a decenyl group.

An alkenyl group having a carbon number of no less than 2 and no greater than 6 as used herein refers to an unsubstituted straight chain or branched chain alkenyl group. Examples of the alkenyl group having a carbon number of no less than 2 and no greater than 6 include an ethenyl group, a propenyl group, a butenyl group, a pentenyl group, and a hexenyl group.

An alkenyl group having a carbon number of no less than 2 and no greater than 4 as used herein refers to an unsubstituted straight chain or branched chain alkenyl group. Examples of the alkenyl group having a carbon number of no less than 2 and no greater than 4 include an ethenyl group, a propenyl group, a 1-butenyl group, and a 2-butenyl group.

An alkoxy group having a carbon number of no less than 1 and no greater than 10 as used herein refers to an unsubstituted straight chain or branched chain alkoxy group. Examples of the alkoxy group having a carbon number of no less than 1 and no greater than 10 include a methoxy group, an ethoxy group, an n-propoxy group, an isopropoxy group, an n-butoxy group, an s-butoxy group, a t-butoxy group, a pentyloxy group, an isopentyloxy group, a neopentyloxy group, a hexyloxy group, a heptyloxy group, an octyloxy group, a nonyloxy group, and a decyloxy group.

An alkoxy group having a carbon number of no less than 1 and no greater than 6 as used herein refers to an unsubstituted straight chain or branched chain alkoxy group. Examples of the alkoxy group having a carbon number of no less than 1 and no greater than 6 include a methoxy group, an ethoxy group, an n-propoxy group, an isopropoxy group, an n-butoxy group, an s-butoxy group, a t-butoxy group, a pentyloxy group, an isopentyloxy group, a neopentyloxy group, and a hexyloxy group.

An alkoxy group having a carbon number of no less than 1 and no greater than 4 as used herein refers to an unsubstituted straight chain or branched chain alkoxy group. Examples of the alkoxy group having a carbon number of no less than 1 and no greater than 4 include a methoxy group, an ethoxy group, an n-propoxy group, an isopropoxy group, an n-butoxy group, an s-butoxy group, and a t-butoxy group.

An aralkyl group having a carbon number of no less than 7 and no greater than 15 as used herein refers to an unsubstituted aralkyl group. An aralkyl group having a carbon number of no less than 7 and no greater than 15 is a group formed through bonding of an aromatic hydrocarbon group having a carbon number of no less than 6 and no greater than 14 with an alkyl group having a carbon number of no less than 1 and no greater than 9.

An aralkyl group having a carbon number of no less than 7 and no greater than 13 as used herein refers to an unsubstituted aralkyl group. An aralkyl group having a carbon number of no less than 7 and no greater than 13 is a group formed through bonding of an aromatic hydrocarbon group having a carbon number of no less than 6 and no greater than 10 with an alkyl group having a carbon number of no less than 1 and no greater than 7.

An aralkyl group having a carbon number of no less than 7 and no greater than 12 as used herein refers to an unsubstituted aralkyl group. An aralkyl group having a carbon number of no less than 7 and no greater than 12 is a group formed through bonding of an aromatic hydrocarbon group having a carbon number of no less than 6 and no greater than 10 with an alkyl group having a carbon number of no less than 1 and no greater than 6.

An aromatic hydrocarbon group having a carbon number of no less than 6 and no greater than 14 as used herein refers to an unsubstituted aromatic hydrocarbon group. Examples of the aromatic hydrocarbon group having a carbon number of no less than 6 and no greater than 14 include: an unsubstituted aromatic monocyclic hydrocarbon group having a carbon number of no less than 6 and no greater than 14; an unsubstituted aromatic polycyclic hydrocarbon group having a carbon number of no less than 6 and no greater than 14; and an unsubstituted group having a carbon number of no less than 6 and no greater than 14 and formed by two or more groups that are selected from at least aromatic monocyclic hydrocarbon groups and aromatic polycyclic hydrocarbon groups and that are singly bonded together (specific examples include a group formed by two benzene rings singly bonded together). Examples of the unsubstituted aromatic monocyclic hydrocarbon group having a carbon number of no less than 6 and no greater than 14 include a phenyl group. The unsubstituted aromatic polycyclic hydrocarbon group having a carbon number of no less than 6 and no greater than 14 is a group formed by two or more aromatic monocyclic hydrocarbons (for example, benzenes) linearly fused or angularly fused together. Examples of the unsubstituted aromatic polycyclic hydrocarbon group having a carbon number of no less than 6 and no greater than 14 include an aromatic bicyclic hydrocarbon group (specific examples include a naphthyl group) and an aromatic tricyclic hydrocarbon group (specific examples include an anthryl group and a phenanthryl group).

An aromatic hydrocarbon group having a carbon number of no less than 6 and no greater than 10 as used herein refers to an unsubstituted aromatic hydrocarbon group. Examples of the aromatic hydrocarbon group having a carbon number of no less than 6 and no greater than 10 include: an unsubstituted aromatic monocyclic hydrocarbon group having a carbon number of no less than 6 and no greater than 10; an unsubstituted aromatic polycyclic hydrocarbon group having a carbon number of no less than 6 and no greater than 10; and an unsubstituted group having a carbon number of no less than 6 and no greater than 10 and formed by two or more groups that are selected from at least aromatic monocyclic hydrocarbon groups and aromatic polycyclic hydrocarbon groups and that are singly bonded together (specific examples include a group formed by two benzene rings singly bonded together). Examples of the unsubstituted aromatic monocyclic hydrocarbon group having a carbon number of no less than 6 and no greater than 10 include a phenyl group. The unsubstituted aromatic polycyclic hydrocarbon group having a carbon number of no less than 6 and no greater than 10 is a group formed by two or more aromatic monocyclic hydrocarbons (for example, benzenes) linearly fused or angularly fused together. Examples of the unsubstituted aromatic polycyclic hydrocarbon group having a carbon number of no less than 6 and no greater than 10 include an aromatic bicyclic hydrocarbon group (specific examples include a naphthyl group).

A heterocyclic group as used herein refers to an unsubstituted heterocyclic group. Examples of the heterocyclic group include a heterocyclic group formed by a five- or six-membered aromatic monocyclic ring including at least one (preferably, no less than 1 and no greater than 3) hetero atom selected from the group consisting of a nitrogen atom, a sulfur atom, and an oxygen atom; a heterocyclic group formed by such monocyclic rings fused together; and a heterocyclic group formed by such a monocyclic ring and a five- or six-membered hydrocarbon ring fused together. The hetero atom is an atom selected from the group consisting of a nitrogen atom, a sulfur atom, and an oxygen atom. Specific examples of heterocyclic groups include a thiophenyl group, a furanyl group, a pyrrolyl group, an imidazolyl group, a pyrazolyl group, isothiazolyl group, an isoxazolyl group, an oxazolyl group, a thiazolyl group, a furazanyl group, a pyranyl group, a pyridyl group, a pyridazinyl group, a pyrimidinyl group, a pyrazinyl group, an indolyl group, a 1H-indazolyl group, an isoindolyl group, a chromenyl group, a quinolinyl group, an isoquinolinyl group, a purinyl group, a pteridinyl group, a triazolyl group, a tetrazolyl group, a 4H-quinolizinyl group, a naphthyridinyl group, a benzofuranyl group, a 1,3-benzodioxolyl group, a benzoxazolyl group, a benzothiazolyl group, and a benzimidazolyl group.

A halogen atom (halogen group) used herein for example refers to a fluorine atom (fluoro group), a chlorine atom (chloro group), a bromine atom (bromo group), or an iodine atom (iodo group).

An aliphatic acyl group having a carbon number of no less than 2 and no greater than 4 used herein refers to an unsubstituted aliphatic acyl group. The aliphatic acyl group having a carbon number of no less than 2 and no greater than 4 is an acyl group formed through bonding of an alkyl group having a carbon number of no less than 1 and no greater than 3 with a carbonyl group. Examples of the aliphatic acyl group having a carbon number of no less than 2 and no greater than 4 include a methylcarbonyl group (acetyl group), an ethylcarbonyl group (propionyl group), and a propylcarbonyl group.

An alkoxycarbonyl group having a carbon number of no less than 2 and no greater than 5 used herein refers to an unsubstituted alkoxycarbonyl group. The alkoxycarbonyl group having a carbon number of no less than 2 and no greater than 5 is an ester group formed through bonding of an alkoxy group having a carbon number of no less than 1 and no greater than 4 with a carbonyl group. Examples of the alkoxycarbonyl group having a carbon number of no less than 2 and no greater than 5 include a methoxycarbonyl group, an ethoxycarbonyl group, a propoxycarbonyl group, and a butoxycarbonyl group.

An alkynyl group having a carbon number of no less than 2 and no greater than 10 used herein refers to an unsubstituted straight chain or branched chain alkynyl group. Examples of the alkynyl group having a carbon number of no less than 2 and no greater than 10 include an ethynyl group, a propynyl group, a butynyl, a pentynyl group, a hexynyl group, a heptynyl group, an octynyl group, a nonynyl group, and a decynyl group.

An alkynyl group having a carbon number of no less than 2 and no greater than 6 used herein refers to an unsubstituted straight chain or branched chain alkynyl group. Examples of the alkynyl group having a carbon number of no less than 2 and no greater than 6 include an ethynyl group, a propynyl group, a butynyl group, a pentynyl group, and a hexynyl group.

An alkynyl group having a carbon number of no less than 2 and no greater than 5 used herein refers to an unsubstituted straight chain or branched chain alkynyl group. Examples of the alkynyl group having a carbon number of no less than 2 and no greater than 5 include an ethynyl group, a propynyl group, a butynyl group, and a pentynyl group.

<First Embodiment: Positively Chargeable Single-Layer Electrophotographic Photosensitive Member>

Figure 1B:
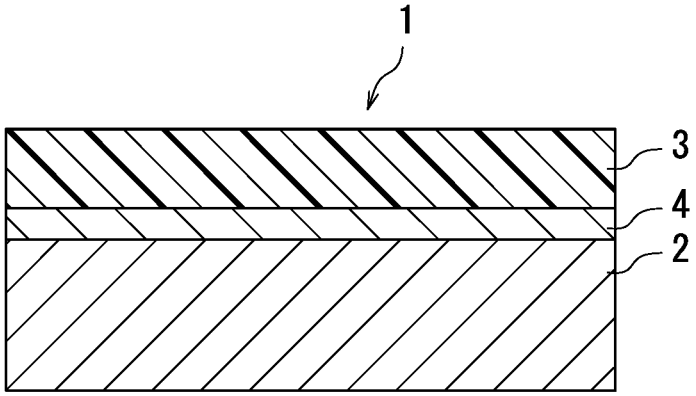
Figure 1C:
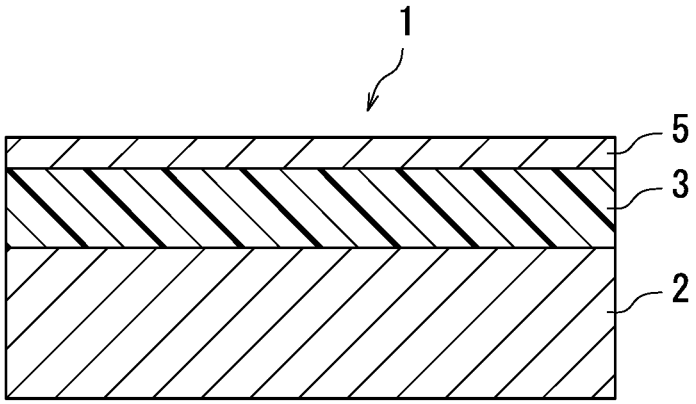

The first embodiment relates to a positively chargeable single-layer electrophotographic photosensitive member (hereinafter, may be referred to as a photosensitive member). The following describes a photosensitive member according to the first embodiment with reference to FIGS. 1A to 1C. FIGS. 1A to 1C are schematic cross-sectional views each illustrating a structure of the photosensitive member according to the first embodiment. A photosensitive member 1 for example includes a conductive and a photosensitive layer 3 as illustrated in FIG. 1A. The photosensitive layer 3 contains at least a charge generating material, a hole transport material, an electron transport material, and an electron accepting compound. The hole transport material includes a benzidine derivative. The electron transport material includes at least one compound selected from the group consisting of compounds represented by general formulae (1), (2), (3), and (4). The electron accepting compound includes at least one compound selected from the group consisting of compounds represented by general formulae (5) and (6).

The photosensitive member 1 according to the first embodiment is capable of restricting occurrence of an image defect resulting from exposure memory and is excellent in sensitivity. Presumably, the reason therefor is as follows.

An electrophotographic image forming apparatus includes an image bearing member (photosensitive member 1), a charging section, a light exposure section, a developing section, and a transfer section. The light exposure section exposes a surface of the photosensitive member 1 charged by the charging section to form an electrostatic latent image on the surface of the photosensitive member 1. More specifically, the charge generating material in the photosensitive layer 3 generates electrons in response to light irradiated onto the photosensitive member 1. The electrons move through the photosensitive layer 3 and reach the positively-charged surface of the photosensitive member 1. As a result, an electrostatic latent image corresponding to an exposure pattern is formed on the surface of the photosensitive member 1.

In the photosensitive member 1 according to the first embodiment, electrons tend to move through the photosensitive layer 3 via at least one compound selected from the group consisting of the compounds represented by the general formulae (1), (2), (3), and (4), and at least one compound selected from the group consisting of the compounds represented by the general formulae (5) and (6). The photosensitive member 1 according to the first embodiment therefore tends to have excellent electron transporting ability. Accordingly, electrons tend not to remain within the photosensitive layer 3, resulting in less residual charges. In a charging step during a next rotation of the photosensitive member, therefore, the potential of an exposed region tends not to decrease due to residual charges, and the photosensitive member 1 according to the first embodiment is readily charged to a desired potential of positive polarity. Thus, the photosensitive member 1 according to the first embodiment can easily restrict occurrence of a phenomenon in which an exposed region has reduced charge ability (so-called exposure memory). Consequently, the photosensitive member 1 according to the first embodiment is thought to be capable of restricting occurrence of an image defect resulting from exposure memory.

Furthermore, having excellent electron transporting ability, the photosensitive member 1 according to the first embodiment is thought to have excellent sensitivity.

The following continues description of the photosensitive member 1 according to the first embodiment. The photosensitive member 1 may further include an intermediate layer 4 and a protective layer 5. The photosensitive layer 3 can be located directly or indirectly on the conductive substrate 2. For example, the photosensitive layer 3 may be located directly on the conductive substrate 2 as illustrated in FIG. 1A. Alternatively, the intermediate layer 4 may for example be located between the conductive substrate 2 and the photosensitive layer 3 as appropriate as illustrated in FIG. 1B. Furthermore, the photosensitive layer 3 may be exposed as an outermost layer as illustrated in FIGS. 1A and 1B. Alternatively, the protective layer 5 may be provided on the photosensitive layer 3 as appropriate as illustrated in FIG. 1C.

No particular limitations are placed on the thickness of the photosensitive layer 3 so long as the thickness thereof is sufficient to ensure that the photosensitive layer achieves its function. The photosensitive layer 3 preferably has a thickness of no less than 5 μm and no greater than 100 μm, and more preferably no less than 10 μm and no greater than 50 μm. Structures of the photosensitive member have been described above with reference to FIGS. 1A to 1C.

The following describes the conductive substrate and the photosensitive layer. Furthermore, the following describes the intermediate layer.

[1. Conductive Substrate]

No particular limitations are placed on the conductive substrate so long as it can be used as a conductive substrate of a photosensitive member. At least a surface portion of the conductive substrate is formed from a conductive material. For example, the conductive substrate may be a conductive substrate formed from a conductive material. For another example, the conductive substrate may be a conductive substrate having a coating of a conductive material. Examples of conductive materials that may be used include aluminum, iron, copper, tin, platinum, silver, vanadium, molybdenum, chromium, cadmium, titanium, nickel, palladium, indium, stainless steel, and brass. One of the conductive materials listed above may be used independently, or two or more of the conductive materials listed above may be used in combination. Examples of the combination of two or more of the conductive materials include alloys. Of the conductive materials listed above, aluminum or an aluminum alloy is preferable in terms of good movement of charge from the photosensitive layer to the conductive substrate.

The shape of the conductive substrate is determined as appropriate according to the structure of an image forming apparatus in which the conductive substrate is used. Examples of the shape of the conductive substrate include a sheet or a drum. The thickness of the conductive substrate is determined as appropriate according to the shape of the conductive substrate.

[2. Photosensitive Layer]

As already mentioned above, the photosensitive layer contains at least a charge generating material, an electron transport material, an electron accepting compound, and a hole transport material. The photosensitive layer may for example further contain a binder resin or an additive. The following describes the charge generating material, the electron transport material, the electron accepting compound, the hole transport material, the binder resin, and the additive.

[2-1. Charge Generating Material]

No particular limitations are placed on the charge generating material so long as it is a charge generating material for a photosensitive member. Examples of charge generating materials that may be used include phthalocyanine-based pigments, perylene pigments, bisazo pigments, dithioketopyrrolopyrrole pigments, metal-free naphthalocyanine pigments, metal naphthalocyanine pigments, squaraine pigments, tris-azo pigments, indigo pigments, azulenium pigments, cyanine pigments, powders of inorganic photoconductive materials such as selenium, selenium-tellurium, selenium-arsenic, cadmium sulfide, or amorphous silicon, pyrylium salts, anthanthrone-based pigments, triphenylmethane-based pigments, threne pigments, toluidine-based pigments, pyrazoline-based pigments, and quinacridone-based pigments. Examples of phthalocyanine-based pigments include metal-free phthalocyanine pigments (specific examples include X-form metal-free phthalocyanine (X-H2Pc)) and metal phthalocyanine derivatives. Examples of metal phthalocyanine derivatives include titanyl phthalocyanine and metal phthalocyanine in which a metal other than titanium oxide is coordinated (for example, v-form hydroxygallium phthalocyanine). The titanyl phthalocyanine may be crystalline, and examples thereof include α-form titanyl phthalocyanine, β-form titanyl phthalocyanine, and Y-form titanyl phthalocyanine. In particular, the charge generating material is preferably a phthalocyanine-based pigment, more preferably metal-free phthalocyanine, and still more preferably X-form metal-free phthalocyanine. One of the charge generating materials listed above may be used independently, or two or more of the charge generating materials listed above may be used in combination.

A single charge generating material having an absorption wavelength in a desired region or a combination of two or more charge generating materials may be used. Furthermore, for example, in a digital optical image forming apparatus (for example, a laser beam printer or facsimile machine that uses a light source such as a semiconductor laser), a photosensitive member that is sensitive to a region of wavelengths of no less than 700 nm is preferably used. Therefore, for example a phthalocyanine-based pigment (specific examples include X-form metal-free phthalocyanine and Y-form titanyl phthalocyanine) is preferably used. No particular limitations are placed on the crystal structure (for example, α-form, β-form, or y-form) of the phthalocyanine-based pigment, and phthalocyanine-based pigments having various different crystal structures may be used.

A photosensitive member included in an image forming apparatus that includes a short-wavelength laser light source preferably contains an anthanthrone-based pigment or a perylene-based pigment as a charge generating material. The short-wavelength laser light for example has a wavelength of no less than 350 nm and no greater than 550 nm.

A reduction potential of the charge generating material is preferably no less than −1.1 V and no greater than −0.7 V versus a reference electrode ($Ag/Ag^+$), and more preferably no less than −1.0 V and no greater than −0.8 V. As a result of the reduction potential of the charge generating material being no less than −1.1 V and no greater than −0.7 V, electrons can easily move through the photosensitive layer. The reduction potential of the charge generating material is measured by the same method as a method for measuring the reduction potential of the electron accepting compound to be described later except that the measurement target is the charge generating material.

The charge generating material is preferably contained in the photosensitive layer of the photosensitive member in an amount of no less than 0.1 parts by mass and no greater than 50 parts by mass relative to 100 parts by mass of the binder resin, and more preferably no less than 0.5 parts by mass and no greater than 30 parts by mass.

[2-2. Electron Transport Material]

The electron transport material contains at least one compound selected from the group consisting of the compounds represented by the general formulae (1), (2), (3), and (4).

(1)

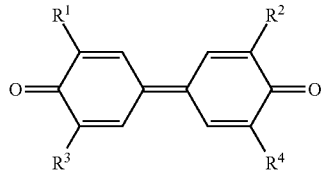

(2)

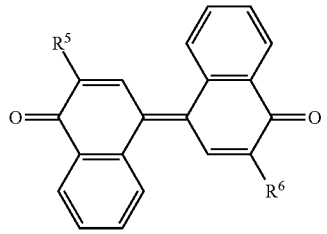

(3)

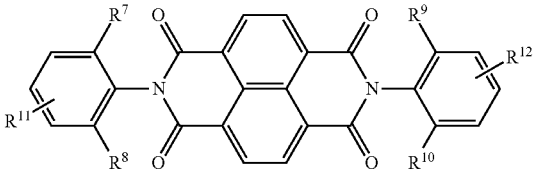

(4)

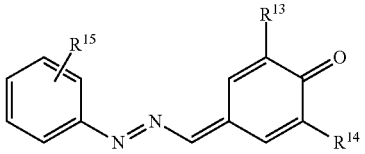

In the general formulae (1) to (4), $R^1$ to $R^{14}$ each represent, independently of one another, a hydrogen atom, an optionally substituted alkyl group, an optionally substituted alkenyl group, an optionally substituted alkoxy group, an optionally substituted aralkyl group, an optionally substituted aromatic hydrocarbon group, or an optionally substituted heterocyclic group. $R^{15}$ represents a halogen atom, a hydrogen atom, an optionally substituted alkyl group, an optionally substituted alkenyl group, an optionally substituted alkoxy group, an optionally substituted aralkyl group, an optionally substituted aromatic hydrocarbon group, or an optionally substituted heterocyclic group.

The alkyl group that may be represented by $R^1$ to $R^{15}$ in the general formulae (1) to (4) is for example an alkyl group having a carbon number of no less than 1 and no greater than 10, preferably an alkyl group having a carbon number of no less than 1 and no greater than 6, more preferably an alkyl group a carbon number of no less than 1 and no greater than 5, and still more preferably a methyl group, an ethyl group, a tert-butyl group, or a 1-methyl-2-butyl group. The alkyl group may be a straight chain alkyl group, a branched chain alkyl group, a ring alkyl group, or an alkyl group that is any combination thereof. The alkyl group is optionally substituted. The alkyl group may for example have a halogen atom, a hydroxyl group, an alkoxy group having a carbon number of no less than 1 and no greater than 4, or a cyano group as a substituent. Although no particular limitations are placed on the number of substituents of the alkyl group, the alkyl group preferably has no greater than three substituents.

The alkenyl group that may be represented by $R^1$ to $R^{15}$ in the general formulae (1) to (4) is for example an alkenyl group having a carbon number of no less than 2 and no greater than 10, preferably an alkenyl group having a carbon number of no less than 2 and no greater than 6, more preferably an alkenyl group having a carbon number of no less than 2 and no greater than 4, and still more preferably an ethenyl group, an allyl group, or a butenyl group. The alkenyl group may be a straight chain alkenyl group, a branched chain alkenyl group, a ring alkenyl group, or an alkenyl group that is any combination thereof. The alkenyl group is optionally substituted. The alkenyl group may for example have a halogen atom, a hydroxyl group, an alkoxy group having a carbon number of no less than 1 and no greater than 4, or a cyano group as a substituent. Although no particular limitations are placed on the number of substituents of the alkenyl group, the alkenyl group preferably has no greater than three substituents.

The alkoxy group that may be represented by $R^1$ to $R^{15}$ in the general formulae (1) to (4) is for example an alkoxy group having a carbon number of no less than 1 and no greater than 10, preferably an alkoxy group having a carbon number of no less than 1 and no greater than 6, more preferably an alkoxy group having a carbon number of no less than 1 and no greater than 4, and still more preferably a methoxy group, an ethoxy group, a propoxy group, or a butoxy group. The alkoxy group may be a straight chain alkoxy group, a branched chain alkoxy group, a ring alkoxy group, or an alkoxy group that is any combination thereof. The alkoxy group is optionally substituted. The alkoxy group may for example have a halogen atom, a hydroxyl group, an alkoxy group having a carbon number of no less than 1 and no greater than 4, or a cyano group as a substituent. Although no particular limitations are placed on the number of substituents of the alkoxy group, the alkoxy group preferably has no greater than three substituents.

The aralkyl group that may be represented by $R^1$ to $R^{15}$ in the general formulae (1) to (4) is for example an aralkyl group having a carbon number of no less than 7 and no greater than 15, preferably an aralkyl group having a carbon number of no less than 7 and no greater than 13, and more preferably an aralkyl group having a carbon number of no less than 7 and no greater than 12. The aralkyl group is optionally substituted. The aralkyl group may for example have a halogen atom, a hydroxyl group, an alkyl group having a carbon number of no less than 1 and no greater than 4, an alkoxy group having a carbon number of no less than 1 and no greater than 4, a nitro group, a cyano group, an aliphatic acyl group having a carbon number of no less than 2 and no greater than 4, a benzoyl group, a phenoxy group, an alkoxycarbonyl group having a carbon number of no less than 2 and no greater than 5, or a phenoxycarbonyl group as a substituent. Although no particular limitations are placed on the number of substituents of the aralkyl group, the aralkyl group preferably has no greater than five substituents, and more preferably no greater than three substituents.

The aromatic hydrocarbon group that may be represented by $R^1$ to $R^{15}$ in the general formulae (1) to (4) is for example an aromatic hydrocarbon group having a carbon number of no less than 6 and no greater than 14, and preferably an aromatic hydrocarbon group having a carbon number of no less than 6 and no greater than 10. The aromatic hydrocarbon group is optionally substituted. The aromatic hydrocarbon group may for example have a halogen atom, a hydroxyl group, an alkyl group having a carbon number of no less than 1 and no greater than 4, an alkoxy group having a carbon number of no less than 1 and no greater than 4, a nitro group, a cyano group, an aliphatic acyl group having a carbon number of no less than 2 and no greater than 4, a benzoyl group, a phenoxy group, an alkoxycarbonyl group including an alkoxy group having a carbon number of no less than 1 and no greater than 4, a phenoxycarbonyl group, or an arylalkenyl group (specific examples include a phenylethenyl group) as a substituent.

In a configuration in which the heterocyclic group that may be represented by $R^1$ to $R^{15}$ in the general formulae (1) to (4) is a fused ring structure, the fused ring structure preferably includes no greater than three rings. The heterocyclic group is optionally substituted. The heterocyclic group may for example have a halogen atom, a hydroxyl group, an alkyl group having a carbon number of no less than 1 and no greater than 4, an alkoxy group having a carbon number of no less than 1 and no greater than 4, a nitro group, a cyano group, an aliphatic acyl group having a carbon number of no less than 2 and no greater than 4, a benzoyl group, a phenoxy group, an alkoxycarbonyl group having a carbon number of no less than 2 and no greater than 5, and a phenoxycarbonyl group as a substituent.

In the general formulae (1) to (4), $R^1$ to $R^{15}$ each preferably represent, independently of one another, an alkyl group having a carbon number of no less than 1 and no greater than 5 or a halogen atom, and more preferably a methyl group, an ethyl group, a tert-butyl group, a 1-methyl-2-butyl group, or a chlorine atom.

The compounds represented by the general formulae (1) to (4) are preferably compounds represented by chemical formulae (ET-1) to (ET-5) shown below (hereinafter, may be referred to as electron transport materials (ET-1) to (ET-5), respectively).

(ET-1)

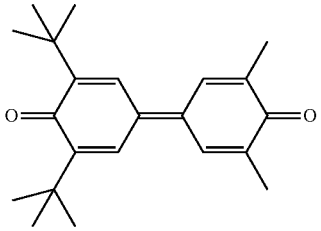

(ET-2)

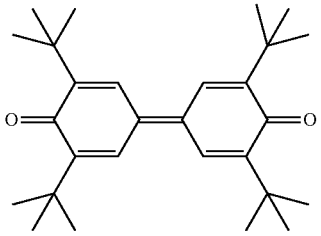

-continued (ET-3)

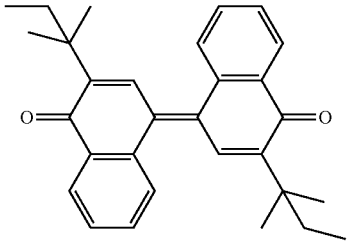

(ET-4)

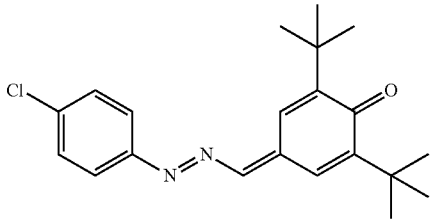

(ET-5)

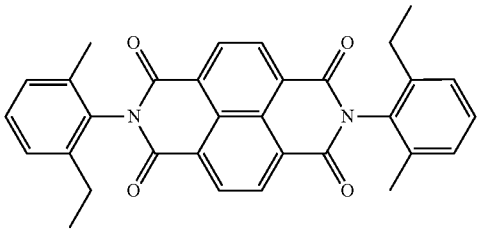

As the electron transport material, one of the compounds represented by the general formulae (1), (2), (3), and (4) may be used independently, or two or more of the compounds may be used in combination. For example, the electron transport material may include two or more of the compounds represented by the general formulae (1), (2), (3), and (4). Alternatively, the electron transport material may be a combination of at least one compound selected from the group consisting of the compounds represented by the general formulae (1), (2), (3), and (4) with a known electron transport material.

The reduction potential of the electron transport material is preferably no greater than −0.85 V versus a reference electrode ($Ag/Ag^+$), more preferably no less than −1.00 V and no greater than −0.85 V, and still more preferably no less than −0.96 V and no greater than −0.88 V. As a result of the reduction potential of the electron transport material being no less than −1.00 V, electrons can easily move through the photosensitive layer. The reduction potential of the electron transport material is measured by the same method as the method for measuring the reduction potential of the electron accepting compound to be described later except that the measurement target is the electron transport material.

The electron transport material is preferably contained in the photosensitive layer 3 of the photosensitive member in an amount of no less than 5 parts by mass and no greater than 100 parts by mass relative to 100 parts by mass of the binder resin, and more preferably no less than 10 parts by mass and no greater than 80 parts by mass.

[2-3. Electron Accepting Compound]

The electron accepting compound includes at least one compound selected from the group consisting of the compounds represented by the general formulae (5) and (6).

(5)

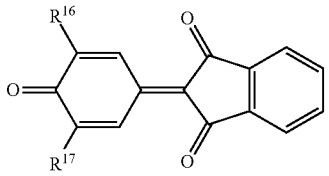

In the general formula (5), $R^{16}$ and $R^{17}$ each represent, independently of one another, a halogen atom, a hydrogen atom, an optionally substituted alkyl group, an optionally substituted alkenyl group, an optionally substituted alkoxy group, an optionally substituted aralkyl group, an optionally substituted aromatic hydrocarbon group, an optionally substituted heterocyclic group, a cyano group, a nitro group, a hydroxyl group, a carboxyl group, an optionally substituted amino group, an optionally substituted acyl group, or an optionally substituted alkynyl group.

The alkyl group that may be represented by $R^{16}$ and $R^{17}$ in the general formula (5) is for example an alkyl group having a carbon number of no less than 1 and no greater than 10, preferably an alkyl group having a carbon number of no less than 1 and no greater than 6, more preferably an alkyl group having a carbon number of no less than 1 and no greater than 5, and still more preferably a tert-butyl group. The alkyl group may be a straight chain alkyl group, a branched chain alkyl group, a ring alkyl group, or an alkyl group that is any combination thereof. The alkyl group is optionally substituted. The alkyl group may for example have a halogen atom, a hydroxyl group, an alkoxy group having a carbon number of no less than 1 and no greater than 4, or a cyano group as a substituent. Although no particular limitations are placed on the number of substituents of the alkyl group, the alkyl group preferably has no greater than three substituents.

The optionally substituted alkenyl group, the optionally substituted alkoxy group, the optionally substituted aralkyl group, the optionally substituted aromatic hydrocarbon group, and the optionally substituted heterocyclic group that may be represented by $R^{16}$ and $R^{17}$ in the general formula (5) are the same as defined for the optionally substituted alkenyl group, the optionally substituted alkoxy group, the optionally substituted aralkyl group, the optionally substituted aromatic hydrocarbon group, and the optionally substituted heterocyclic group that may be represented by $R^1$ to $R^{15}$ in the general formulae (1) to (4), respectively. The halogen atom that may be represented by $R^{16}$ and $R^{17}$ in the general formula (5) is the same as defined for the halogen atom that may be represented by $R^{15}$ in the general formula (4).

The amino group that may be represented by $R^{16}$ and $R^{17}$ in the general formula (5) is optionally substituted. The amino group may for example have an alkyl group as a substituent. The alkyl group is the same as defined for the alkyl group that may be represented by $R^1$ to $R^{14}$ in the general formulae (1) to (4). The amino group preferably has one or two substituents.

The acyl group that may be represented by $R^{16}$ and $R^{17}$ in the general formula (5) is for example an acyl group having a carbon number of no less than 1 and no greater than 10, preferably an acyl group having a carbon number of no less than 1 and no greater than 7, more preferably a formyl group, an aliphatic acyl group having a carbon number of no less than 2 and no greater than 4 (specific examples include an acetyl group and a propionyl group), or a benzoyl group. The aliphatic acyl group and the benzoyl group are optionally substituted. The aliphatic acyl group and the benzoyl group may for example have a halogen atom, a hydroxyl group, an alkoxy group having a carbon number of no less than 1 and no greater than 4, or a cyano group as a substituent. Although no particular limitations are placed on the number of substituents of the acyl group, the acyl group preferably has no greater than three substituents.

The alkynyl group that may be represented by $R^{16}$ and $R^{17}$ in the general formula (5) is for example an alkynyl group having a carbon number of no less than 2 and no greater than 10, preferably an alkynyl group having a carbon number of no less than 2 and no greater than 6, more preferably an alkynyl group having a carbon number of no less than 2 and no greater than 5, and still more preferably an ethynyl group, a 1-propynyl group, a 2-propynyl group, a 3-butynyl group, or a pentynyl group. The alkynyl group is optionally substituted. The alkynyl group may for example have a halogen atom, a hydroxyl group, an alkoxy group having a carbon number of no less than 1 and no greater than 4, or a cyano group as a substituent. Although no particular limitations are placed on the number of substituents of the alkynyl group, the alkynyl group preferably has no greater than three substituents.

(6)

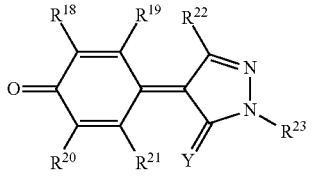

In the general formula (6), $R^{18}$ to $R^{23}$ each represent, independently of one another, a halogen atom, a hydrogen atom, an optionally substituted alkyl group, an optionally substituted alkenyl group, an optionally substituted alkoxy group, an optionally substituted aralkyl group, an optionally substituted aromatic hydrocarbon group, an optionally substituted heterocyclic group, a cyano group, a nitro group, a hydroxyl group, a carboxyl group, an optionally substituted amino group, an optionally substituted acyl group, or an optionally substituted alkynyl group. X represents an oxygen atom, a sulfur atom, or $=C(CN)_2$. Y represents an oxygen atom or a sulfur atom.

The alkyl group that may be represented by $R^{18}$ to $R^{23}$ in the general formula (6) is for example an alkyl group having a carbon number of no less than 1 and no greater than 10, preferably an alkyl group having a carbon number of no less than 1 and no greater than 6, more preferably an alkyl group having a carbon number of no less than 1 and no greater than 5, and still more preferably an isopropyl group or a tert-butyl group. The alkyl group may be a straight chain alkyl group, a branched chain alkyl group, a ring alkyl group, or an alkyl group that is any combination thereof. The alkyl group is optionally substituted. The alkyl group may for example have a halogen atom, a hydroxyl group, an alkoxy group having a carbon number of no less than 1 and no greater than 4, or a cyano group as a substituent. Although no particular limitations are placed on the number of substituents of the alkyl group, the alkyl group preferably has no greater than three substituents.

The aromatic hydrocarbon group that may be represented by $R^{18}$ to $R^{23}$ in the general formula (6) is for example an aromatic hydrocarbon group having a carbon number of no less than 6 and no greater than 14, and preferably a phenyl group. The aromatic hydrocarbon group that may be represented by $R^{18}$ to $R^{23}$ in the general formula (6) is optionally substituted. The aromatic hydrocarbon group may for example have a halogen atom, a hydroxyl group, an alkyl group having a carbon number of no less than 1 and no greater than 4, an alkoxy group having a carbon number of no less than 1 and no greater than 4, a nitro group, a cyano group, an aliphatic acyl group having a carbon number of no less than 2 and no greater than 4, a benzoyl group, a phenoxy group, an alkoxycarbonyl group having a carbon number of no less than 2 and no greater than 5, a phenoxycarbonyl group, or an arylalkenyl group (specific examples include a phenylethenyl group) as a substituent. In particular, the aromatic hydrocarbon group preferably has a halogen atom, an alkoxy group having a carbon number of no less than 1 and no greater than 4, or an alkyl group having a carbon number of no less than 1 and no greater than 4 as a substituent, and more preferably a chlorine atom.

The halogen atom, the optionally substituted alkenyl group, the optionally substituted alkoxy group, the optionally substituted aralkyl group, the optionally substituted heterocyclic group, the optionally substituted amino group, the optionally substituted acyl group, and the optionally substituted alkynyl group that may be represented by $R^{18}$ to $R^{23}$ in the general formula (6) are the same as defined for the halogen atom, the optionally substituted alkenyl group, the optionally substituted alkoxy group, the optionally substituted aralkyl group, the optionally substituted heterocyclic group, the optionally substituted amino group, the optionally substituted acyl group, and the optionally substituted alkynyl group that may be represented by $R^{16}$ and $R^{17}$ in the general formula (5).

In the general formula (6), X represents an oxygen atom, a sulfur atom, or $=C(CN)_2$, and preferably an oxygen atom. Y represents an oxygen atom or a sulfur atom, and preferably an oxygen atom.

In the general formulae (5) and (6), preferably, $R^{16}$ to $R^{23}$ each represent, independently of one another, a phenyl group that may have one or more halogen atoms, a hydrogen atom, or an alkyl group having a carbon number of no less than 1 and no greater than 4, and X and Y each represent an oxygen atom. More preferably, $R^{16}$ to $R^{23}$ each represent, independently of one another, a phenyl group that may have two chlorine atoms, a hydrogen atom, an isopropyl group, or a tert-butyl group, and X and Y each represent an oxygen atom.

The compounds represented by the general formulae (5) to (6) are preferably compounds represented by chemical formulae (EA-1) to (EA-3) shown below (hereinafter, may be referred to as electron accepting compounds (EA-1) to (EA-3), respectively).

(EA-1)

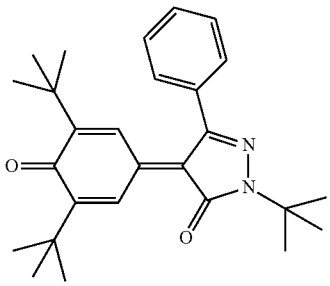

-continued (EA-2)

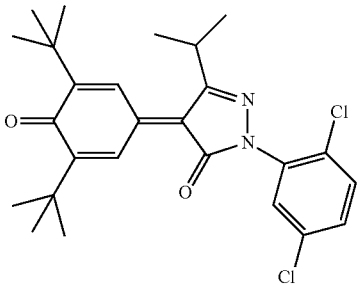

(EA-3)

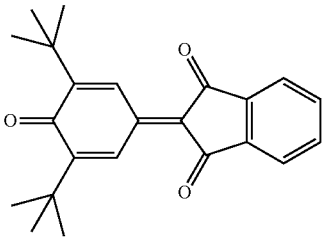

As the electron accepting compound, one of the compounds represented by the general formulae (5) and (6) may be used independently, or two or more of the compounds represented by the general formulae (5) and (6) may be used in combination. For example, the electron accepting compound may be a combination of the compound represented by the general formula (5) or (6) with another electron accepting compound.

The reduction potential of the electron accepting compound is preferably no greater than −0.80 V versus a reference electrode (Ag/Ag+), more preferably no less than −0.80 V and no greater than −0.60 V, and still more preferably no less than −0.77 V and no greater than −0.66 V. As a result of the reduction potential of the electron accepting compound being no less than −0.80 V, electrons can easily move through the photosensitive layer 3.

The reduction potential of the electron accepting compound is determined by cyclic voltammetry under the following conditions.

Working electrode: glassy carbon

Counter electrode: platinum

Reference electrode: silver/silver nitrate (0.1 mol/L, a solution of $AgNO_3$ in acetonitrile)

Sample solution electrolyte: tetra-n-butylammonium perchlorate (0.1 mol)

Measurement target: electron accepting compound (0.001 mol)

Solvent: dichloromethane (1 L)

The electron accepting compound is preferably contained in an amount of no less than 10 parts by mass and no greater than 30 parts by mass relative to 100 parts by mass of the binder resin, and more preferably no less than 15 parts by mass and no greater than 25 parts by mass. As a result of the electron accepting compound being contained in an amount of no less than 10 parts by mass and no greater than 30 parts by mass relative to 100 parts by mass of the binder resin, occurrence of exposure memory is easily restricted.

[2-4. Hole Transport Material]

The hole transport material includes a benzidine derivative. The benzidine derivative is for example a compound represented by general formula (7), and preferably a compound represented by chemical formula (HT-1), chemical formula (HT-2), or chemical formula (HT-3) shown below (hereinafter, may be referred to as a hole transport material (HT-1), (HT-2), or (HT-3)).

(7)

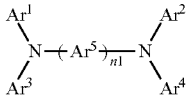

(HT-1)

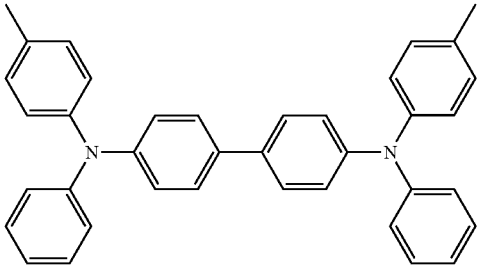

(HT-2)

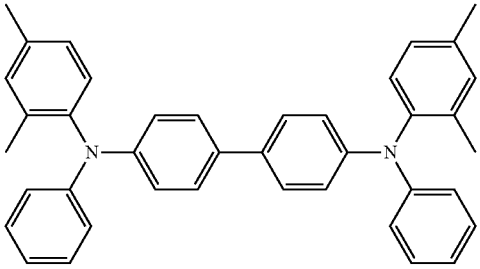

(HT-3)

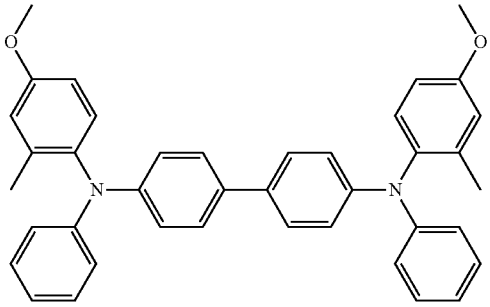

In the general formula (7), $Ar^1$ to $Ar^4$ each represent, independently of one another, an aromatic hydrocarbon group that may have one or more substituents. $Ar^5$ represents a phenylene group. n1 represents 2.

The aromatic hydrocarbon group represented by $Ar^1$ to $Ar^4$ in the general formula (7) is for example a hydrocarbon group having a carbon number of no less than 6 and no greater than 14, and preferably a phenyl group. The aromatic hydrocarbon group is optionally substituted. The aromatic hydrocarbon group may for example have a halogen atom, a hydroxyl group, an alkyl group having a carbon number of no less than 1 and no greater than 4, an alkoxy group having a carbon number of no less than 1 and no greater than 4, a nitro group, a cyano group, an aliphatic acyl group having a carbon number of no less than 2 and no greater than 4, a benzoyl group, a phenoxy group, an alkoxycarbonyl group including an alkoxy group having a carbon number of no less than 1 and no greater than 4, a phenoxycarbonyl group, or an arylalkenyl group (specific examples include a phenylethenyl group) as a substituent. In particular, the aromatic hydrocarbon group preferably has an alkyl group having a carbon number of no less than 1 and no greater than 4 or an alkoxy group having a carbon number of no less than 1 and no greater than 4, and more preferably a methyl group or a methoxy group as a substituent.

In the general formula (7), $Ar^5$ represents a phenyl group. n1 represents the number of arylene groups that may be represented by $Ar^5$. n1 represents 2.

As the hole transport material, one of the compounds represented by the general formula (7) may be used independently, or two or more of the compounds represented by the general formula (7) may be used in combination. Alternatively, as the hole transport material, one of the compounds represented by general formula (7) and another hole transport material may be used in combination. No particular limitations are placed on the other hole transport material so long as the hole transport material is applicable to a photosensitive member. Examples of hole transport materials that may be used include nitrogen-containing cyclic compounds and condensed polycyclic compounds. Examples of the nitrogen-containing cyclic compounds and the condensed polycyclic compounds include triphenylamine derivatives, oxadiazole-based compounds (for example, 2,5-di(4-methylaminophenyl)-1,3,4-oxadiazole), styryl-based compounds (for example, 9-(4-diethylaminostyryl) anthracene), carbazole-based compounds (for example, polyvinyl carbazole), organic polysilane compounds, pyrazoline-based compound (for example, 1-phenyl-3-(p-di methylaminophenyl)pyrazoline), hydrazone-based compounds, indole-based compounds, oxazole-based compounds, isoxazole-based compounds, thiazole-based compounds, thiadiazole-based compounds, imidazole-based compounds, pyrazole-based compounds, and triazole-based compounds.

The hole transport material is preferably contained in the photosensitive layer 3 of the photosensitive member 1 in an amount of no less than 10 parts by mass and no greater than 200 parts by mass relative to 100 parts by mass of the binder resin, and more preferably in an amount of no less than 10 parts by mass and no greater than 100 parts by mass.

[2-5. Binder Resin]

Examples of binder resins that may be used include thermoplastic resins, thermosetting resins, and photocurable resins. Examples of thermoplastic resins that may be used include polycarbonate resins, styrene-based resins, styrene-butadiene copolymers, styrene-acrylonitrile copolymers, styrene-maleic acid copolymers, styrene-acrylic acid copolymers, acrylic copolymers, polyethylene resins, ethylene-vinyl acetate copolymers, chlorinated polyethylene resins, polyvinyl chloride resins, polypropylene resins, ionomers, vinyl chloride-vinyl acetate copolymers, alkyd resins, polyamide resins, urethane resins, polyarylate resins, polysulfone resins, diallyl phthalate resins, ketone resins, polyvinyl butyral resins, polyether resins, and polyester resins. Examples of thermosetting resins that may be used include silicone resins, epoxy resins, phenolic resins, urea resins, melamine resins, and other crosslinkable thermosetting resins. Examples of photocurable resins that may be used include epoxy acrylate resins and urethane-acrylate copolymers. One of the binder resins listed above may be used independently, or two or more of the binder resins listed above may be used in combination.

In particular, the binder resin is preferably a polycarbonate resin for obtaining a photosensitive layer 3 having excellent balance in terms of processability, mechanical properties, optical properties, and abrasion resistance. Examples of polycarbonate resins that may be used include bisphenol Z polycarbonate resin, bisphenol B polycarbonate resin, bisphenol CZ polycarbonate resin, bisphenol C polycarbonate resin, and bisphenol A polycarbonate resin. A more specific example of the polycarbonate resins is a resin having a repeating unit represented by chemical formula (Resin-1) (hereinafter, may be referred to as a bisphenol Z polycarbonate resin (Resin-1).

(Resin-1)

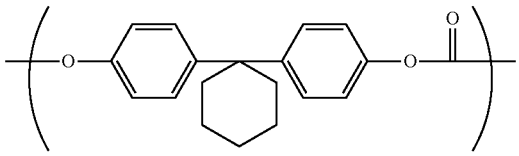

In terms of molecular weight, the binder resin preferably has a viscosity average molecular weight of no less than 40,000, and more preferably no less than 40,000 and no greater than 52,500. As a result of the binder resin having a viscosity average molecular weight of no less than 40,000, the binder resin may have sufficient abrasion resistance and as a consequence abrasion of the photosensitive layer has a low tendency to occur. As a result of the binder resin having a viscosity average molecular weight of no greater than 52,500, the binder resin has a high tendency to dissolve in a solvent and viscosity of an application liquid has a low tendency to be too high during formation of the photosensitive layer. Consequently, the photosensitive layer is readily formed.

[2-6. Additives]

The photosensitive layer 3 in the photosensitive member according to the first embodiment may contain various additives to the extent that such additives do not adversely affect electrophotographic properties of the photosensitive layer. Examples of additives that may be used include antidegradants (for example, antioxidants, radical scavengers, singlet quenchers, and ultraviolet absorbing agents), softeners, surface modifiers, extenders, thickeners, dispersion stabilizers, waxes, acceptors, donors, surfactants, plasticizers, sensitizers, and leveling agents. Examples of antioxidants include hindered phenols, hindered amines, paraphenylenediamine, arylalkanes, hydroquinone, spirochromanes, spiroindanones, derivatives of any of the above compounds, organosulfur compounds, and organophosphorus compounds.

[3. Intermediate Layer]

As already mentioned above, the intermediate layer (in particular, an undercoat layer) may be located between the conductive substrate and the photosensitive layer in the photosensitive member. The intermediate layer for example contains inorganic particles and a resin (intermediate layer resin). Provision of the intermediate layer may facilitate flow of current generated when the photosensitive member 1 is exposed to light and inhibit increasing resistance, while also maintaining insulation to a sufficient degree so as to inhibit leakage current from occurring.

Examples of inorganic particles that may be used include particles of metals (for example, aluminum, iron, and copper), particles of metal oxides (for example, titanium oxide, alumina, zirconium oxide, tin oxide, and zinc oxide), and particles of non-metal oxides (for example, silica). Any one type of inorganic particles listed above may be used or a combination of any two or more types of inorganic particles listed above may be used.

No particular limitations are placed on the intermediate layer resin other than being a resin that can be used to form an intermediate layer.

The intermediate layer may contain various additives to the extent that such additives do not adversely affect electrophotographic properties of the photosensitive layer. The additives are the same as defined for the additives for the photosensitive layer.

The following describes a manufacturing method of the photosensitive member 1 according to the first embodiment with reference to FIGS. 1A to 1C. The manufacturing method of the photosensitive member 1 according to the first embodiment for example includes a photosensitive layer formation step. In the photosensitive layer formation step, an application liquid is applied onto the conductive substrate 2, and a solvent contained in the applied application liquid is removed to form the photosensitive layer 3.

The application liquid may contain a charge generating material, at least one electron transport material selected from the group consisting of the compounds represented by the general formulae (1) to (4), at least one electron accepting compound selected from the group consisting of the compounds represented by the general formulae (5) and (6), a benzidine derivative as a hole transport material, a binder resin, and a solvent. The application liquid can be prepared by dissolving or dispersing the charge generating material, the at least one electron transport material selected from the group consisting of the compounds represented by the general formulae (1) to (4), the at least one electron accepting compound selected from the group consisting of the compounds represented by the general formulae (5) and (6), the benzidine derivative as a hole transport material, and the binder resin in the solvent. The application liquid may contain various additives as necessary.

No particular limitations are placed on the solvent contained in the application liquid so long as the components of the application liquid are soluble or dispersible in the solvent. Examples of solvents that may be used include alcohols (for example, methanol, ethanol, isopropanol, and butanol), aliphatic hydrocarbons (for example, n-hexane, octane, and cyclohexane), aromatic hydrocarbons (for example, benzene, toluene, and xylene), halogenated hydrocarbons (for example, dichloromethane, dichloroethane, carbon tetrachloride, and chlorobenzene), ethers (for example, dimethyl ether, diethyl ether, tetrahydrofuran, ethylene glycol dimethyl ether and diethylene glycol dimethyl ether), ketones (for example, acetone, methyl ethyl ketone, and cyclohexanone), esters (for example, ethyl acetate and methyl acetate), dimethyl formaldehyde, N,N-dimethylformamide (DMF), and dimethyl sulfoxide. One of the solvents listed above may be used independently, or two or more of the solvents listed above may be used in combination. Of the solvents listed above, a non-halogenated solvent is preferable.

The application liquid is prepared by mixing the components and dispersing the components in the solvent. Mixing or dispersion can for example be performed using a bead mill, a roll mill, a ball mill, an attritor, a paint shaker, or an ultrasonic disperser.

The application liquid may for example contain a surfactant or a leveling agent in order to improve dispersibility of the components thereof, or surface smoothness of a layer to be formed therefrom.

No particular limitations are placed on the method by which the application liquid is applied so long as the method for example enables uniform application of the application liquid onto the conductive substrate 2. Examples of the application method include dip coating, spray coating, spin coating, and bar coating.

No particular limitations are placed on the method by which the solvent contained in the application liquid is removed so long as the method enables evaporation of the solvent contained in the application liquid. Examples of the solvent removing method include heating, depressurization, and a combination of heating and depressurization. Specific examples thereof include heat treatment (hot-air drying) using a high-temperature dryer or a reduced pressure dryer. The heat treatment is for example performed for no less than 3 minutes and no greater than 120 minutes at a temperature of no less than 40° C. and no greater than 150° C.

The manufacturing method of the photosensitive member 1 may further include either or both of a step of forming the intermediate layer 4 and a step of forming the protective layer 5 as necessary. An appropriate known method may be employed for the step of forming the intermediate layer 4 and the step of forming the protective layer 5.

The photosensitive member 1 according to the first embodiment has been described above with reference to FIGS. 1A to 1C. The photosensitive member 1 according to the first embodiment is capable of restricting occurrence of an image defect resulting from exposure memory and is excellent in sensitivity.

<Second Embodiment: Image Forming Apparatus>

Figure 2:
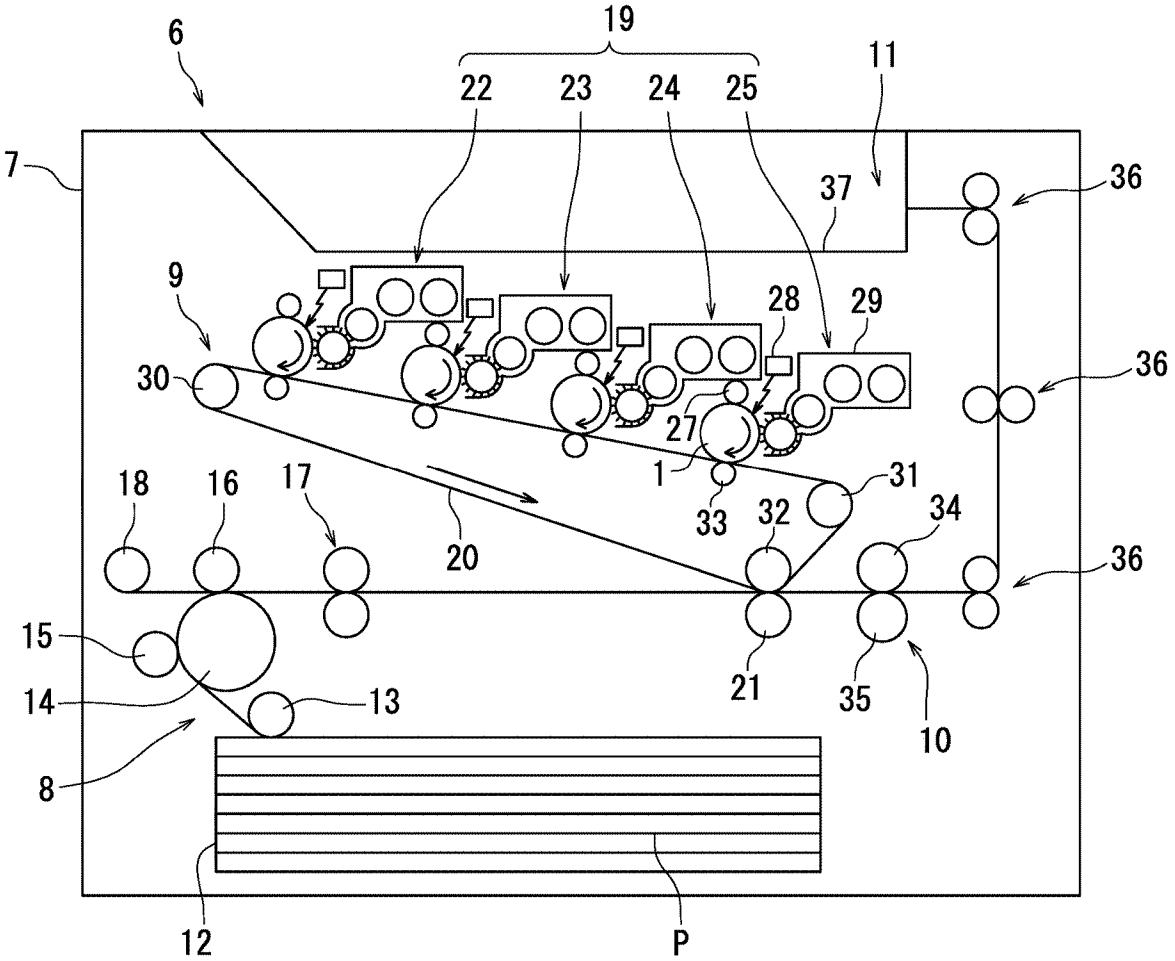
FIG. 2 is a schematic view illustrating configuration of an image forming apparatus according to a second embodiment.

The second embodiment relates to an image forming apparatus. The following describes an aspect of an image forming apparatus according to the second embodiment with reference to FIG. 2. FIG. 2 is a schematic view illustrating configuration of the image forming apparatus according to the second embodiment. An image forming apparatus 6 includes the photosensitive member 1 according to the first embodiment.

The image forming apparatus 6 according to the second embodiment includes an image bearing member 1, which is equivalent to a photosensitive member, a charging section 27, which is equivalent to a charger, a light exposure section 28, which is equivalent to a light exposure device, a developing section 29, which is equivalent to a developing device, and a transfer section. The charging section 27 charges a surface of the image bearing member 1. The charging section 27 has a positive charging polarity. The light exposure section 28 exposes the charged surface of the image bearing member 1 to light to form an electrostatic latent image on the surface of the image bearing member 1. The developing section 29 develops the electrostatic latent image into a toner image. The transfer section transfers the toner image onto a transfer target from the image bearing member 1. In a configuration in which the image forming apparatus 6 adopts an intermediate transfer process as illustrated in FIG. 2, the transfer section is equivalent to a primary transfer roller 33. The transfer target is equivalent to an intermediate transfer member (intermediate transfer belt 20).

The image forming apparatus 6 according to the second embodiment includes the photosensitive member 1 according to the first embodiment as the image bearing member. The image forming apparatus 6 according to the second embodiment can therefore restrict occurrence of an image defect (for example, an image ghost) resulting from exposure memory. Presumably, the reason therefor is as follows.

First, for convenience, an image defect resulting from exposure memory will be described. If the exposure memory occurs as described earlier, a region of the surface of the image bearing member 1 that cannot be charged to a desired potential in a charging step during the next rotation of the photosensitive member tends to have a lower potential than other regions that can be charged to a desired potential in the charging step during the next rotation of the photosensitive member. More specifically, when charged during the next rotation of the photosensitive member, a region of the surface of the image bearing member 1 that was exposed to light during the previous rotation tends to have a lower potential than regions of the surface of the image bearing member 1 that were not exposed to light during the previous rotation. Having a lower potential than the regions that were not exposed to light during the previous rotation in the charging step, the region that was exposed to light during the previous rotation has a high tendency to attract positively charged toner in a developing step. As a consequence, an image originating from a portion imaged (the region exposed to light) during the previous rotation tends to be formed. Such an image defect that occurs due to formation of an image originating from a portion imaged during the previous rotation is an image defect resulting from exposure memory.

Figure 3:
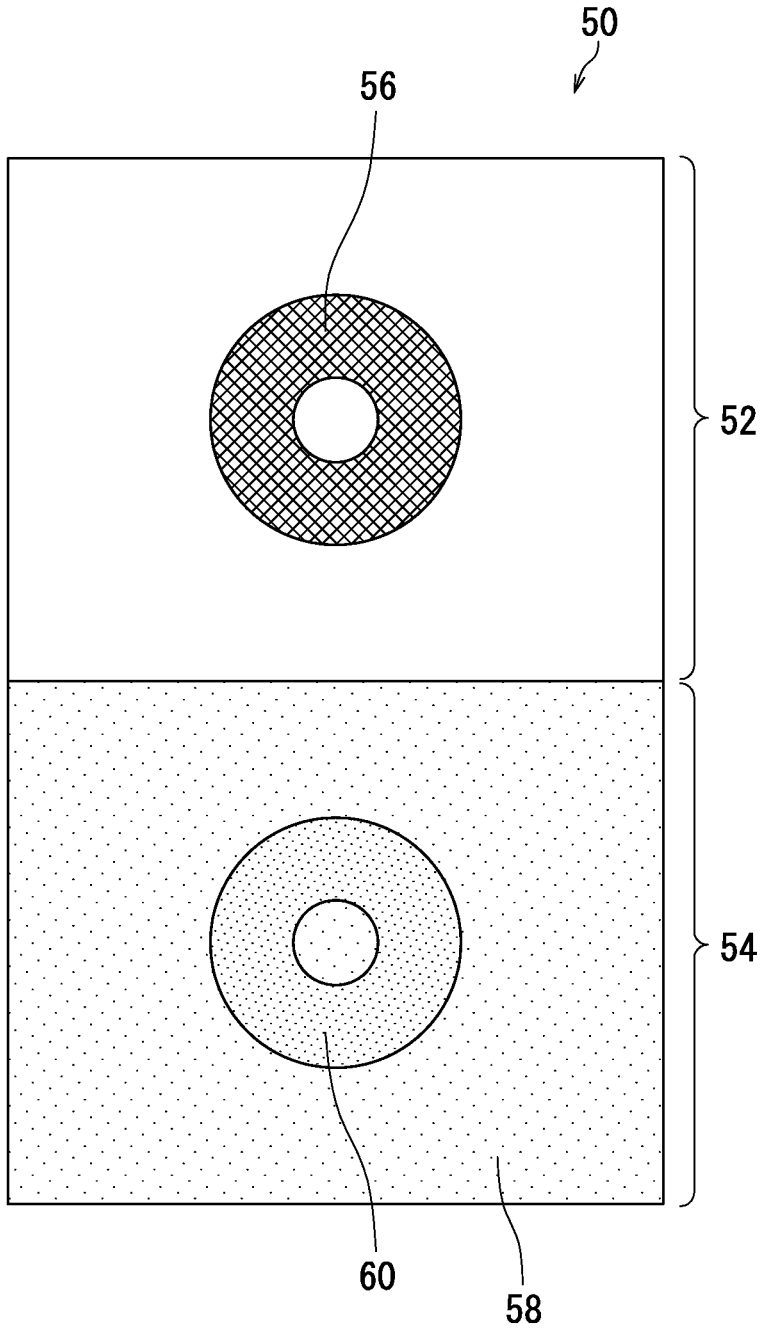
FIG. 3 is a schematic illustration of an image having an image ghost.

The following describes an image having an image defect with reference to FIG. 3. FIG. 3 is a schematic illustration of an image 50 having an image ghost. An area 52 corresponds to one rotation of the image bearing member 1. An area 54 also corresponds to one rotation of the image bearing member 1. An image 56 in the area 52 is a toroidal solid image. An image 58 in the area 54 is a halftone image as originally designed. First, the image 56 in the area 52 is formed. Subsequently, the image 58 in the area 54 is formed. The image 56 is an image corresponding to the preceding one rotation of the photosensitive member. The image 58 is an image corresponding to the subsequent one rotation of the photosensitive member. In such a situation, an image 60 originating from the exposed region in the area 52 is formed as an image ghost in the area 54. The image 60 has a greater image density than the image 58.

As mentioned above, the photosensitive member 1 according to the first embodiment tends to restrict occurrence of an image defect resulting from exposure memory. Including the photosensitive member 1 according to the first embodiment as the image bearing member, the image forming apparatus 6 according to the second embodiment is thought to be capable of restricting occurrence of an image defect resulting from exposure memory.

No particular limitations are placed on the image forming apparatus 6 so long as it is an electrophotographic image forming apparatus. The image forming apparatus 6 may for example be a monochrome image forming apparatus or a color image forming apparatus. The image forming apparatus 6 may be a tandem color image forming apparatus that forms toner images of different colors using different color toners.

The following describes an example in which the image forming apparatus 6 is a tandem color image forming apparatus. The image forming apparatus 6 includes a plurality of the photosensitive members 1 arranged in a specific direction and a plurality of the developing sections 29. The developing sections 29 are arranged in one-to-one correspondence with the photosensitive members 1. Each of the developing sections 29 includes a development roller. The development roller bears a toner thereon and conveys and supplies the toner to the surface of a corresponding one of the image bearing members 1.

As illustrated in FIG. 2, the image forming apparatus 6 has a box shaped apparatus housing 7. The apparatus housing 7 houses a paper feed section 8, an image forming section 9, and a fixing section 10. The paper feed section 8 feeds paper P. The image forming section 9 transfers a toner image based on image data onto the paper P fed from the paper feed section 8 while conveying the paper P. The fixing section 10 fixes, to the paper P, the unfixed toner image that has been transferred onto the paper P by the image forming section 9. A paper ejection section 11 is provided on a top surface of the apparatus housing 7. The paper ejection section 11 ejects the paper P after the paper P has been subjected to a fixing process by the fixing section 10.

The paper feed section 8 includes a paper feed cassette 12, a first pick-up roller 13, paper feed rollers 14, 15, and 16, and a pair of registration rollers 17. The paper feed cassette 12 is detachable from the apparatus housing 7. Various sizes of paper P can be loaded into the paper feed cassette 12. The first pick-up roller 13 is located above a left-hand side of the paper feed cassette 12. The first pick-up roller 13 picks up paper P one sheet at a time from the paper feed cassette 12 in which the paper P is loaded. The paper feed rollers 14, 15, and 16 convey the paper P that is picked up by the first pick-up roller 13. The pair of registration rollers 17 temporarily halts the paper P that is conveyed by the paper feed rollers 14, 15, and 16, and subsequently feeds the paper P to the image forming section 9 at a specific timing.

The paper feed section 8 further includes a manual feed tray (not illustrated) and a second pick-up roller 18. The manual feed tray is attached to a left side surface of the apparatus housing 7. The second pick-up roller 18 picks up paper P that is loaded on the manual feed tray. The paper P that is picked up by the second pick-up roller 18 is then conveyed by the paper feed rollers 14, 15, and 16, and fed to the image forming section 9 at the specific timing by the pair of registration rollers 17.

The image forming section 9 includes an image forming unit 19, an intermediate transfer belt 20, and a secondary transfer roller 21. The image forming unit 19 performs primary transfer of a toner image onto a peripheral surface of the intermediate transfer belt 20 (a surface in contact with the surfaces of the image bearing members 1). The toner image that is subjected to primary transfer is formed based on image data that is transmitted from a higher-level device such as a computer. The secondary transfer roller 21 performs secondary transfer of the toner image on the intermediate transfer belt 20 to paper P that is fed from the paper feed cassette 12.

The image forming unit 19 includes a yellow toner supply unit 25, a magenta toner supply unit 24, a cyan toner supply unit 23, and a black toner supply unit 22. In the image forming unit 19, the yellow toner supply unit 25, the magenta toner supply unit 24, the cyan toner supply unit 23, and the black toner supply unit 22 are arranged in stated order from upstream (right-hand side of FIG. 2) to downstream of a rotation direction of the intermediate transfer belt 20. Each of the photosensitive members 1 is provided at a central position in a corresponding one of the toner supply units 22, 23, 24, and 25. The photosensitive member 1 is rotatable in an arrow direction (i.e., clockwise). The toner supply units 22, 23, 24, and 25 may be process cartridges to be described later that are attached to or detached from the body of the image forming apparatus 6.

Around each of the photosensitive members 1, the charging section 27, the light exposure section 28, and the developing section 29 are arranged in stated order from upstream to downstream in a rotation direction of the photosensitive member 1.

A static eliminator (not illustrated) and a cleaning device (not illustrated) may be provided upstream of the charging section 27 in the rotation direction of the image bearing member 1. Once primary transfer of the toner image onto the intermediate transfer belt 20 is complete, the static eliminator eliminates static electricity from the circumferential surface (surface) of the image bearing member 1. After the surface of the image bearing member 1 has been cleaned by the cleaning device and static electricity has been eliminated from the surface by the static eliminator, the surface of the image bearing member 1 returns to a position corresponding to the charging section 27 and a new charging process is performed.

The image forming apparatus 6 according to the second embodiment may include either or both of cleaning sections (equivalent to cleaning devices) and static eliminating sections (equivalent to static eliminators). In a configuration in which the image forming apparatus 6 according to the second embodiment includes the cleaning sections and the static eliminating sections, each of the cleaning sections and each of the static eliminating sections are arranged as follows. That is, around each of the image bearing members 1, the charging section 27, the light exposure section 28, the developing section 29, the primary transfer roller 33, the cleaning section, and the static eliminating section are arranged in stated order from upstream to downstream in the rotation direction of the image bearing member 1.

As already mentioned above, the charging section 27 charges the surface of the image bearing member 1. More specifically, the charging section 27 uniformly charges the surface of the image bearing member 1. No particular limitations are placed on the charging section 27 so long as it can uniformly charge the surface of the image bearing member 1. The charging section 27 may be a non-contact charging section or a contact charging section. When the charging section 27 is a contact charging section, the charging section 27 is for example a charging roller or a charging brush. The charging section 27 is preferably a contact charging section (specific examples include a charging roller and a charging brush). Emission of active gases (for example, ozone and nitrogen oxides) produced by the charging section 27 can be restricted in a configuration in which the charging section 27 is a contact charging section. As a result, degradation of the photosensitive layer 3 by the active gases can be inhibited while also enabling apparatus design that takes into account use in an office environment.

In a configuration in which the charging section 27 includes a contact charging roller, the charging roller charges the surface of the image bearing member 1 while in contact with the image bearing member 1. The charging roller may for example be rotationally driven by rotation of the image bearing member 1 while in contact with the surface of the image bearing member 1. Furthermore, at least a surface section of the charging roller may for example be formed from a resin. In a more specific example, the charging roller includes a metal core that is axially supported in a rotatable manner, a resin layer formed on the metal core, and a voltage application section that applies voltage to the metal core. In a configuration in which the charging section 27 includes a charging roller such as described above, the surface of the photosensitive member 1 can be charged via the resin layer in contact with the photosensitive member 1 as a result of the voltage applying section applying voltage to the metal core.

No particular limitations are placed on the resin forming the resin layer of the charging roller, so long as the resin enables favorable charging of the surface of the image bearing member 1. Specific examples of resins that may be used to form the resin layer include silicone resins, urethane resins, and silicone modified resins. The resin layer may optionally contain an inorganic filler.

No particular limitations are placed on the voltage applied by the charging section 27. However, it is more preferable for the charging section 27 to only apply a direct current voltage than for the charging section 27 to apply an alternating current voltage or a superimposed voltage of an alternating current voltage superimposed on a direct current voltage. The reason for the above is that abrasion of the photosensitive layer 3 tends to be smaller in a configuration in which the charging section 27 only applies a direct current voltage. As a result, favorable images can be formed. The charging section 27 preferably applies a direct current voltage to the photosensitive member 1 of no less than 1,000 V and no greater than 2,000 V, more preferably no less than 1,200 V and no greater than 1,800 V, and particularly preferably no less than 1,400 V and no greater than 1,600 V.

The light exposure section 28 is for example a laser scanning unit. The light exposure section 28 forms an electrostatic latent image on the surface of the image bearing member 1 by exposing the surface of the image bearing member 1 to light while in a charged state. More specifically, after the surface of the image bearing member 1 has been uniformly charged by the charging section 27, the light exposure section 28 irradiates the surface of the image bearing member 1 with laser light based on image data input from a higher-level device such as a personal computer. Through the above, an electrostatic latent image based on the image data is formed on the surface of the image bearing member 1.

As already mentioned above, the developing section 29 develops the electrostatic latent image into a toner image. More specifically, the developing section 29 forms a toner image based on the image data by supplying toner to the surface of the image bearing member 1 once the electrostatic latent image has been formed thereon. Next, primary transfer of the formed toner image onto the intermediate transfer belt 20 is performed. The toner has a positive charging polarity.

The intermediate transfer belt 20 is an endless circulating belt. The intermediate transfer belt 20 is stretched around a drive roller 30, a driven roller 31, a backup roller 32, and the primary transfer rollers 33. The intermediate transfer belt 20 is disposed such that the surface of each of the image bearing members 1 is in contact with the peripheral surface of the intermediate transfer belt 20.

The intermediate transfer belt 20 is pressed against each of the image bearing members 1 by a corresponding one of the primary transfer rollers 33 that is located opposite to the image bearing member 1. The intermediate transfer belt 20 circulates endlessly in an arrow direction (i.e., counterclockwise) while in the pressed state through the primary transfer rollers 30. The drive roller 30 is rotationally driven by a drive source such as a stepper motor and imparts driving force on the intermediate transfer belt 20 that causes endless circulation of the intermediate transfer belt 20. The driven roller 31, the backup roller 32, and the primary transfer rollers 33 are freely rotatable. The driven roller 31, the backup roller 32, and the primary transfer rollers 33 passively rotate in accompaniment to endless circulation of the intermediate transfer belt 20 by the drive roller 30. The driven roller 31, the backup roller 32, and the primary transfer rollers 33 passively rotate through the intermediate transfer belt 20, in response to active rotation of the drive roller 30, while supporting the intermediate transfer belt 20.

Each of the primary transfer rollers 33 transfers the toner image from a corresponding one of the image bearing members 1 to the intermediate transfer belt 20. More specifically, each of the primary transfer rollers 33 applies a primary transfer bias (specifically, a bias of opposite polarity to toner charging polarity) to the intermediate transfer belt 20. As a result, toner images formed on the image bearing members 1 are transferred (primary transfer) onto the intermediate transfer belt 20 in order as the intermediate transfer belt 20 circulates between each of the photosensitive members 1 and the corresponding primary transfer roller 33.

The secondary transfer roller 21 applies a secondary transfer bias (specifically, a bias of opposite polarity to the toner images) to the paper P. As a result, the toner images that have been transferred onto the intermediate transfer belt 20 by primary transfer are transferred onto the paper P between the secondary transfer roller 21 and the backup roller 32. Through the above, an unfixed toner image is transferred onto the paper P.

The fixing section 10 fixes, to the paper P, the unfixed toner image that has been transferred onto the paper P by the image forming section 9. The fixing section 10 includes a heating roller 34 and a pressure roller 35. The heating roller 34 is heated by a conductive heating element. The pressure roller 35 is located opposite to the heating roller 34 and has a circumferential surface that is pressed against a circumferential surface of the heating roller 34.

The transferred image that has been transferred onto the paper P by the secondary transfer roller 21 in the image forming section 9 is subsequently fixed to the paper P through a fixing process in which the paper P is heated as the paper P passes between the heating roller 34 and the pressure roller 35. After the paper P has been subjected to the fixing process, the paper P is ejected to the paper ejection section 11. A plurality of conveyance rollers 36 are provided at appropriate locations between the fixing section 10 and the paper ejection section 11.

The paper ejection section 11 is formed by a recess in a top part of the apparatus housing 7. An exit tray 37 for receiving the ejected paper P is provided at the bottom of the recess. The image forming apparatus 6 according to the second embodiment has been described above with reference to FIG. 2.

As described above with reference to FIG. 2, the image forming apparatus 6 according to the second embodiment includes, as the image bearing members, the photosensitive members 1 according to the first embodiment that are capable of restricting occurrence of an image defect resulting from exposure memory. Including the photosensitive members 1, the image forming apparatus 6 according to the second embodiment can restrict occurrence of an image defect resulting from exposure memory.

Although the image forming apparatus 6 that adopts an intermediate transfer process is described with reference to FIG. 2, the image forming apparatus 6 according to an alternative aspect of the second embodiment may adopt a direct transfer process. According to the aspect of the second embodiment, the transfer target is equivalent to a recording medium (for example, paper P). The transfer section is equivalent to a plurality of the secondary transfer rollers 21. The secondary transfer rollers 21 are disposed opposite to the respective image bearing members 1 such that a recording medium is conveyed between the secondary transfer rollers 21 and the image bearing members 1.

<Third Embodiment: Process Cartridge>

The third embodiment relates to a process cartridge. A process cartridge according to the third embodiment includes the photosensitive member 1 according to the first embodiment as an image bearing member. The process cartridge according to the third embodiment can restrict occurrence of an image defect resulting from exposure memory. Presumably, the reason therefor is as follows. As described above, the photosensitive member 1 according to the first embodiment tends to restrict occurrence of an image defect resulting from exposure memory. The process cartridge according to the third embodiment is thought to be capable of restricting occurrence of an image defect resulting from exposure memory as including the photosensitive member 1 according to the first embodiment as an image bearing member.

The process cartridge may for example adopt a unitized configuration and include the photosensitive member 1 according to the first embodiment as an image bearing member in the unitized configuration. The process cartridge may be designed to be freely attachable to and detachable from the image forming apparatus 6 according to the second embodiment. The process cartridge may for example adopt a unitized configuration including, in addition to the image bearing member, at least one section selected from the group consisting of a charging section, a light exposure section, a developing section, a transfer section, a cleaning section, and a static eliminating section. The charging section, the light exposure section, the developing section, the cleaning section, and the static eliminating section may for example have the same configuration as the charging section 27, the light exposure section 28, the developing section 29, the cleaning section, and the static eliminating section described in the second embodiment, respectively.

The process cartridge according to the third embodiment has been described above. The process cartridge according to the third embodiment can restrict occurrence of an image defect resulting from exposure memory. Furthermore, the above-described process cartridge is easy to handle and therefore can be replaced readily and quickly with the photosensitive member 1 included therein when properties such as sensitivity characteristics of the photosensitive member 1 degrade.

EXAMPLES

The following provides more specific description of the present disclosure through use of Examples. The present disclosure is not limited to the scope of the Examples.

[1. Preparation of Photosensitive Member]

Photosensitive members (A-1) to (A-40) and (B-1) to (B-23) were each prepared using a charge generating material, an electron transport material, a hole transport material, and a binder resin.

[1-1. Preparation of Charge Generating Material]

In the preparation of the photosensitive members (A-1) to (A-40) and (B-1) to (B-23), X-form metal-free phthalocyanine represented by chemical formula (CG-1) (hereinafter, may be referred to as a charge generating material (CG-1)) was used as a charge generating material.

(OG-1)

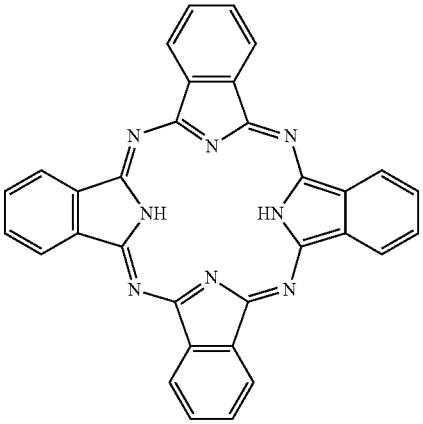

[1-2. Preparation of Electron Transport Material]

In the preparation of each of the photosensitive members (A-1) to (A-40) and (B-4) to (B-23), a specified one of the electron transport materials (ET-1) to (ET-5) described in the first embodiment was used.

[1-3. Preparation of Electron Accepting Compound]

In the preparation of each of the photosensitive members (A-1) to (A-40), (B-1) to (B-3), and (B-9) to (B-23), a specified one of the electron accepting compounds (EA-1) to (EA-3) described in the first embodiment was used.

[1-4. Preparation of Hole Transport Material]

In preparation of each of the photosensitive members (A-1) to (A-40) and (B-1) to (B-23), a specified one of compounds represented by chemical formulae (HT-4) and (HT-5) (hereinafter, may be referred to as hole transport materials (HT-4) and (HT-5)) and the hole transport materials (HT-1) to (HT-3) described in the first embodiment was used as a hole transport material.

(HT-4)

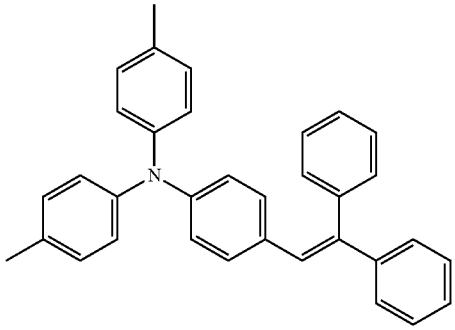

(HT-5)

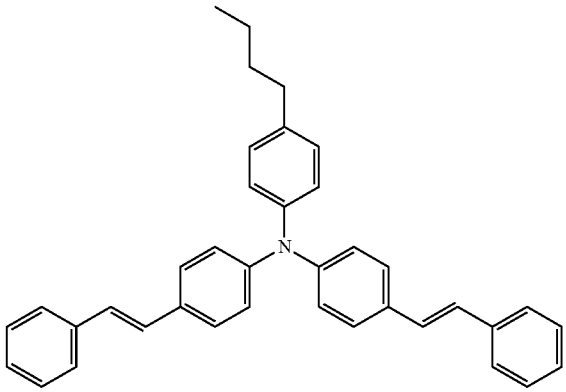

[1-5. Preparation of Binder Resin]

In the preparation of the photosensitive members (A-1) to (A-40) and (B-1) to (B-23), the bisphenol Z polycarbonate resin (Resin-1) (viscosity average molecular weight: 30,000) described in the first embodiment was used as a binder resin.

[1-6. Manufacture of Photosensitive Member (A-1)]

First, 3 parts by mass of X-form metal-free phthalocyanine (OG-1) as a charge generating material, 30 parts by mass of the electron transport material (ET-1), 20 parts by mass of the electron accepting compound (EA-1), 50 parts by mass of the hole transport material (HT-1), 100 parts by mass of the bisphenol Z polycarbonate resin (Resin-1) as a binder resin, and 700 parts by mass of tetrahydrofuran as a solvent were added into a container. The container contents were mixed for dispersion for 50 hours using a ball mill to give an application liquid.

The application liquid was applied onto a conductive substrate (an aluminum drum-shaped support having a diameter of 30 mm) by dip coating to form a film of the application liquid on the conductive substrate. Next, the film of the application liquid was dried using hot air at 130° C. blown for 45 minutes to remove tetrahydrofuran from the film. As a result, the photosensitive member (A-1) including the conductive substrate and a photosensitive layer having a film thickness of 30 μm on the conductive substrate was obtained.

[1-6. Preparation of Photosensitive Members (A-2) to (A-40) and (B-1) to (B-23)]

The photosensitive members (A-2) to (A-40) and (B-1) to (B-23) were prepared in the same manner as in the preparation of the photosensitive member (A-1) except the following changes. That is, instead of the electron transport material (ET-1), the electron accepting compound (EA-1), and the hole transport material (HT-1) used in the preparation of the photosensitive member (A-1), an electron transport material, an electron accepting compound, and a hole transport material as specified in Tables 1 to 5 shown below were used for each of the photosensitive members (A-2) to (A-40) and (B-1) to (B-23). The amount of each electron accepting compound shown in Tables 1 to 5 is an amount (parts by mass) relative to 100 parts by mass of the corresponding electron transport material.

[1. Performance Evaluation of Photosensitive Member]

The following evaluations were performed on the photosensitive members (A-1) to (A-40) and (B-1) to (B-23) obtained as described above.

(Sensitivity Evaluation)

With respect to each of the photosensitive members, the photosensitive member was charged to +700 V using a drum sensitivity test device (product of Gen-Tech, Inc.). A potential of the photosensitive member in the charged state was measured to be an initial surface potential ($V_o$). Next, a band pass filter was used to obtain monochromatic light (wavelength: 780 nm, half-width: 20 nm, light intensity: 1.5 μJ/cm$^2$) from light emitted by a halogen lamp. The monochromatic light was irradiated onto the surface of the photosensitive member (irradiation time: 1.5 seconds). The surface potential of the photosensitive member was measured once 0.5 seconds had elapsed after completion of the irradiation and the measured surface potential was taken to be a sensitivity potential ($V_L$). Measurement was performed under ambient conditions of 23° C. and 50% relative humidity. The sensitivity potentials thus obtained are shown in Tables 1 to 5. A sensitivity potential having a smaller value indicates that the photosensitive member has higher sensitivity.

(Image Defect Evaluation)

With respect to each of the photosensitive members, the photosensitive member was installed in an image forming apparatus (modified version of LS-5030, product of KYOCERA Document Solutions Inc.). An evaluation image was printed on 10 successive sheets under the following conditions. The evaluation image was formed in a low temperature and low humidity environment (temperature: 10° C., relative humidity: 15%).

Drum linear velocity: 168 mm/second

Drum: φ30 positively chargeable single-layer organic photoconductor (OPC)

Charging: scorotron charging

Light exposure: laser scanner

Development: touchdown development

Transfer: intermediate transfer process

Cleaning: counter blade

Static elimination: static elimination with LED light

Drum charge potential: 420 V

Laser: laser wavelength 780 nm, laser exposure dose 0.9 μJ/cm$^2$

Static elimination: LED wavelength 500 nm, LED exposure dose 4.0 μJ/cm$^2$

Light emitting diode: GaAs

Figure 4:
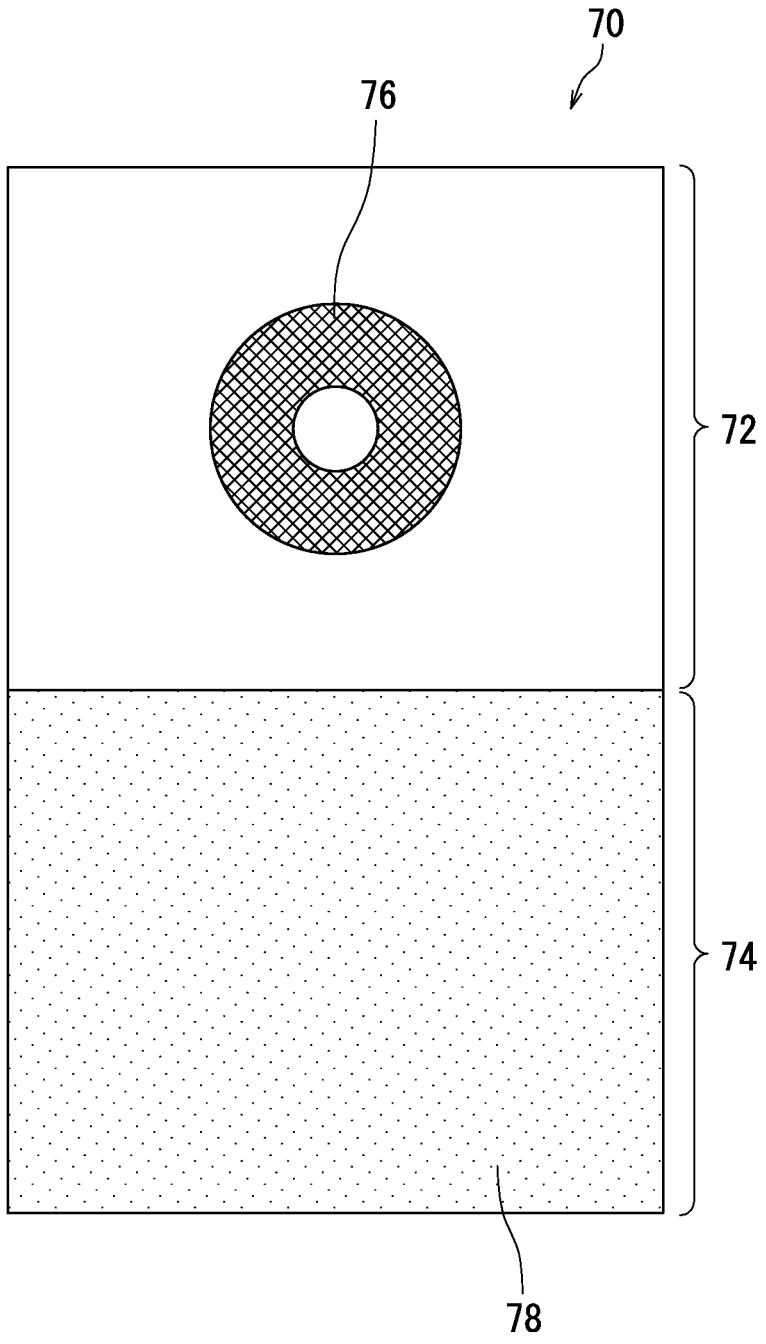
FIG. 4 is a schematic illustration of an evaluation image.

The following describes the evaluation image with reference to FIG. 4. FIG. 4 is a schematic illustration of an evaluation image 70. An area 72 corresponds to one rotation of the image bearing member 1. An area 74 also corresponds to one rotation of the image bearing member 1. An image 76 in the area 72 is a toroidal solid image (image density: 100%). The solid image includes a pair of concentric circles. An image 78 in the area 74 is a halftone image (image density: 12.5%). First, the image 76 in the area 72 is formed. Subsequently, the image 78 in the area 74 is formed. The image 76 is an image corresponding to the preceding one rotation of the image bearing member 1. The image 78 is an image corresponding to the subsequent one rotation of the image bearing member 1. Such image formation was repeated 10 times.

Next, the lastly obtained image (the image on the 10$^{th}$ sheet) was visually observed for presence in the area 74 of an image corresponding to the image 76. The visual observation refers to observation with an unaided eye (unaided eye observation) or observation through a loupe (×10, TL-SL10K, product of TRUSCO NAKAYAMA CORPORATION) (loupe observation). Presence of an image defect (image ghost) resulting from exposure memory was determined. The following evaluation standard was used for evaluation based on presence of an image ghost. An evaluation of A or B was determined to pass the evaluation.

A: An image ghost was not observed at all by unaided eye observation or by loupe observation.

B: An image ghost was not observed by unaided eye observation but was slightly observed by loupe observation.

C: An image ghost was slightly observed by unaided eye observation.

D: An image ghost was clearly observed by unaided eye observation.

TABLE 1

| | | | Electron transport material | | Electron accepting compound | | | | |
|---|---|---|---|---|---|---|---|---|---|
| Photosensitive member No. | Charge generating material | Hole transport material | Compound | Reduction potential/V | Compound | Reduction potential/V | Amount/ parts by mass | Image ghost | Sensitivity potential/V |
| A-1 | CG-1 | HT-1 | ET-1 | −0.93 | EA-1 | −0.77 | 20 | A | +120 |
| A-2 | CG-1 | HT-1 | ET-2 | −0.96 | EA-1 | −0.77 | 20 | A | +122 |
| A-3 | CG-1 | HT-1 | ET-3 | −0.88 | EA-1 | −0.77 | 20 | A | +115 |
| A-4 | CG-1 | HT-1 | ET-4 | −0.92 | EA-1 | −0.77 | 20 | A | +117 |
| A-5 | CG-1 | HT-1 | ET-5 | −0.92 | EA-1 | −0.77 | 20 | A | +121 |
| A-6 | CG-1 | HT-1 | ET-1 | −0.93 | EA-2 | −0.70 | 20 | A | +114 |
| A-7 | CG-1 | HT-1 | ET-2 | −0.96 | EA-2 | −0.70 | 20 | A | +119 |
| A-8 | CG-1 | HT-1 | ET-3 | −0.88 | EA-2 | −0.70 | 20 | A | +113 |
| A-9 | CG-1 | HT-1 | ET-4 | −0.92 | EA-2 | −0.70 | 20 | A | +112 |
| A-10 | CG-1 | HT-1 | ET-5 | −0.92 | EA-2 | −0.70 | 20 | A | +116 |
| A-11 | CG-1 | HT-1 | ET-1 | −0.93 | EA-3 | −0.66 | 20 | A | +124 |
| A-12 | CG-1 | HT-1 | ET-2 | −0.96 | EA-3 | −0.66 | 20 | A | +120 |
| A-13 | CG-1 | HT-1 | ET-3 | −0.88 | EA-3 | −0.66 | 20 | A | +118 |
| A-14 | CG-1 | HT-1 | ET-4 | −0.92 | EA-3 | −0.66 | 20 | A | +119 |
| A-15 | CG-1 | HT-1 | ET-5 | −0.92 | EA-3 | −0.66 | 20 | A | +116 |
| A-16 | CG-1 | HT-1 | ET-5 | −0.92 | EA-3, EA-2 | −0.66, −0.70 | 10, 10 | A | +119 |

TABLE 2

| | | | Electron transport material | | Electron accepting compound | | | | |
|---|---|---|---|---|---|---|---|---|---|
| Photosensitive member No. | Charge generating material | Hole transport material | Compound | Reduction potential/V | Compound | Reduction potential/V | Amount/ parts by mass | Image ghost | Sensitivity potential/V |
| A-17 | CG-1 | HT-1 | ET-5 | −0.92 | EA-2 | −0.70 | 10 | B | +116 |
| A-18 | CG-1 | HT-1 | ET-5 | −0.92 | EA-2 | −0.70 | 30 | B | +113 |
| A-19 | CG-1 | HT-1 | ET-5 | −0.92 | EA-2 | −0.70 | 5 | B | +115 |
| A-20 | CG-1 | HT-1 | ET-5 | −0.92 | EA-2 | −0.70 | 35 | B | +115 |
| A-21 | CG-1 | HT-2 | ET-1 | −0.93 | EA-2 | −0.70 | 20 | A | +113 |
| A-22 | CG-1 | HT-2 | ET-2 | −0.96 | EA-2 | −0.70 | 20 | A | +120 |
| A-23 | CG-1 | HT-2 | ET-3 | −0.88 | EA-2 | −0.70 | 20 | A | +110 |
| A-24 | CG-1 | HT-2 | ET-4 | −0.92 | EA-2 | −0.70 | 20 | A | +112 |
| A-25 | CG-1 | HT-2 | ET-5 | −0.92 | EA-3 | −0.66 | 20 | A | +111 |
| A-26 | CG-1 | HT-2 | ET-1 | −0.93 | EA-3 | −0.66 | 20 | A | +111 |
| A-27 | CG-1 | HT-2 | ET-2 | −0.96 | EA-3 | −0.66 | 20 | A | +120 |
| A-28 | CG-1 | HT-2 | ET-3 | −0.88 | EA-3 | −0.66 | 20 | A | +119 |
| A-29 | CG-1 | HT-2 | ET-4 | −0.92 | EA-3 | −0.66 | 20 | A | +119 |
| A-30 | CG-1 | HT-2 | ET-5 | −0.92 | EA-3 | −0.66 | 20 | A | +116 |
| A-31 | CG-1 | HT-3 | ET-1 | −0.93 | EA-2 | −0.70 | 20 | A | +112 |
| A-32 | CG-1 | HT-3 | ET-2 | −0.96 | EA-2 | −0.70 | 20 | A | +114 |

TABLE 3

| Photosensitive member No. | Charge generating material | Hole transport material | Electron transport material: Compound | Electron transport material: Reduction potential/V | Electron accepting compound: Compound | Electron accepting compound: Reduction potential/V | Amount/ parts by mass | Image ghost | Sensitivity potential/V |
|---|---|---|---|---|---|---|---|---|---|
| A-33 | CG-1 | HT-3 | ET-3 | −0.88 | EA-2 | −0.70 | 20 | A | +115 |
| A-34 | CG-1 | HT-3 | ET-4 | −0.92 | EA-2 | −0.70 | 20 | A | +122 |
| A-35 | CG-1 | HT-3 | ET-5 | −0.92 | EA-3 | −0.66 | 20 | A | +121 |
| A-36 | CG-1 | HT-3 | ET-1 | −0.93 | EA-3 | −0.66 | 20 | A | +112 |
| A-37 | CG-1 | HT-3 | ET-2 | −0.96 | EA-3 | −0.66 | 20 | A | +122 |
| A-38 | CG-1 | HT-3 | ET-3 | −0.88 | EA-3 | −0.66 | 20 | A | +117 |
| A-39 | CG-1 | HT-3 | ET-4 | −0.92 | EA-3 | −0.66 | 20 | A | +114 |
| A-40 | CG-1 | HT-3 | ET-5 | −0.92 | EA-3 | −0.66 | 20 | A | +115 |

TABLE 4

| Photosensitive member No. | Charge generating material | Hole transport material | Electron transport material: Compound | Electron transport material: Reduction potential/V | Electron accepting compound: Compound | Electron accepting compound: Reduction potential/V | Amount/ parts by mass | Image ghost | Sensitivity potential/V |
|---|---|---|---|---|---|---|---|---|---|
| B-1 | CG-1 | HT-1 | — | — | EA-1 | −0.77 | 20 | D | +171 |
| B-2 | CG-1 | HT-1 | — | — | EA-2 | −0.70 | 20 | D | +183 |
| B-3 | CG-1 | HT-1 | — | — | EA-3 | −0.66 | 20 | D | +175 |
| B-4 | CG-1 | HT-1 | ET-1 | −0.93 | — | — | — | D | +115 |
| B-5 | CG-1 | HT-1 | ET-2 | −0.96 | — | — | — | D | +124 |
| B-6 | CG-1 | HT-1 | ET-3 | −0.88 | — | — | — | D | +113 |
| B-7 | CG-1 | HT-1 | ET-4 | −0.92 | — | — | — | D | +116 |
| B-8 | CG-1 | HT-1 | ET-5 | −0.92 | — | — | — | D | +120 |
| B-9 | CG-1 | HT-1 | ET-1, ET-3 | −0.93, −0.88 | — | — | — | D | +120 |
| B-10 | CG-1 | HT-4 | ET-1 | −0.93 | EA-1 | −0.77 | 20 | C | +135 |
| B-11 | CG-1 | HT-4 | ET-1 | −0.93 | EA-2 | −0.70 | 20 | C | +131 |
| B-12 | CG-1 | HT-4 | ET-1 | −0.93 | EA-3 | −0.66 | 20 | C | +134 |
| B-13 | CG-1 | HT-4 | ET-2 | −0.96 | EA-3 | −0.66 | 20 | C | +132 |
| B-14 | CG-1 | HT-4 | ET-3 | −0.88 | EA-3 | −0.66 | 20 | C | +137 |
| B-15 | CG-1 | HT-4 | ET-4 | −0.92 | EA-3 | −0.66 | 20 | C | +129 |
| B-16 | CG-1 | HT-4 | ET-5 | −0.92 | EA-3 | −0.66 | 20 | C | +132 |

TABLE 5

| Photosensitive member No. | Charge generating material | Hole transport material | Electron transport material: Compound | Electron transport material: Reduction potential/V | Electron accepting compound: Compound | Electron accepting compound: Reduction potential/V | Amount/ parts by mass | Image ghost | Sensitivity potential/V |
|---|---|---|---|---|---|---|---|---|---|
| B-17 | CG-1 | HT-5 | ET-1 | −0.93 | EA-1 | −0.77 | 20 | C | +123 |
| B-18 | CG-1 | HT-5 | ET-1 | −0.93 | EA-2 | −0.70 | 20 | C | +115 |
| B-19 | CG-1 | HT-5 | ET-1 | −0.93 | EA-3 | −0.66 | 20 | C | +123 |
| B-20 | CG-1 | HT-5 | ET-2 | −0.96 | EA-3 | −0.66 | 20 | C | +115 |
| B-21 | CG-1 | HT-5 | ET-3 | −0.88 | EA-3 | −0.66 | 20 | C | +118 |
| B-22 | CG-1 | HT-5 | ET-4 | −0.92 | EA-3 | −0.66 | 20 | C | +119 |
| B-23 | CG-1 | HT-5 | ET-5 | −0.92 | EA-3 | −0.66 | 20 | C | +120 |

As shown in Tables 1 to 5, the photosensitive members (A-1) to (A-40) had an evaluation of A or B in the image defect evaluation. The photosensitive members (B-1) to (B-23) had an evaluation of C or D in the image defect evaluation. The results indicate that the photosensitive members (A-1) to (A-40) have more ability to restrict occurrence of an image defect resulting from exposure memory than the photosensitive members (B-1) to (B-23).

The results of the sensitivity evaluation and the image defect evaluation indicate that the photosensitive members (A-1) to (A-40) are superior to the photosensitive members (B-1) to (B-23) in terms of sensitivity and ability to restrict occurrence of an image defect resulting from exposure memory. Furthermore, it has been revealed that image forming apparatuses including the photosensitive members (A-1) to (A-40) have more ability to restrict occurrence of an image defect resulting from exposure memory than image forming apparatuses including the photosensitive members (B-1) to (B-23).

What is claimed is:

1. A positively chargeable single-layer electrophotographic photosensitive member comprising a conductive substrate and a photosensitive layer, wherein the photosensitive layer contains at least a charge generating material, a hole transport material, an electron transport material, and an electron accepting compound, the hole transport material includes a benzidine derivative, the electron transport material includes a compound represented by general formula (4) shown below, and the electron accepting compound includes a compound represented by general formula (6) shown below, (4)

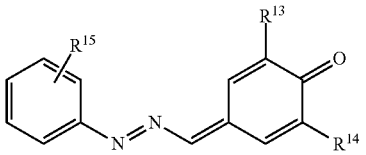

where in the general formula (4), $R^{13}$ and $R^{14}$ each represent, independently of one another, a hydrogen atom, an optionally substituted alkyl group, an optionally substituted alkenyl group, an optionally substituted alkoxy group, an optionally substituted aralkyl group, an optionally substituted aromatic hydrocarbon group, or an optionally substituted heterocyclic group, and $R^{15}$ represents a halogen atom, a hydrogen atom, an optionally substituted alkyl group, an optionally substituted alkenyl group, an optionally substituted alkoxy group, an optionally substituted aralkyl group, an optionally substituted aromatic hydrocarbon group, or an optionally substituted heterocyclic group, and (6)

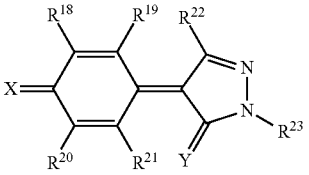

in the general formula (6), $R^{18}$ to $R^{23}$ each represent, independently of one another, a halogen atom, a hydrogen atom, an optionally substituted alkyl group, an optionally substituted alkenyl group, an optionally substituted alkoxy group, an optionally substituted aralkyl group, an optionally substituted aromatic hydrocarbon group, an optionally substituted heterocyclic group, a cyano group, a nitro group, a hydroxyl group, a carboxyl group, an optionally substituted amino group, an optionally substituted acyl group, or an optionally substituted alkynyl group, X represents an oxygen atom, a sulfur atom, or $=C(CN)_2$, and Y represents an oxygen atom or a sulfur atom.

2. The positively chargeable single-layer electrophotographic photosensitive member according to claim 1, wherein the benzidine derivative includes a compound represented by chemical formula (HT-1), chemical formula (HT-2), or chemical formula (HT-3) shown below (HT-1)

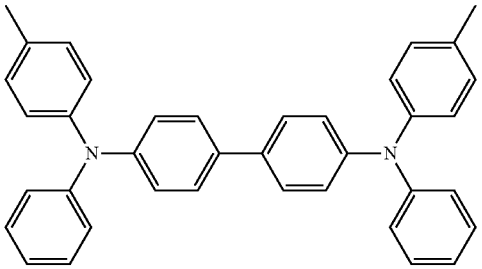

(HT-2)

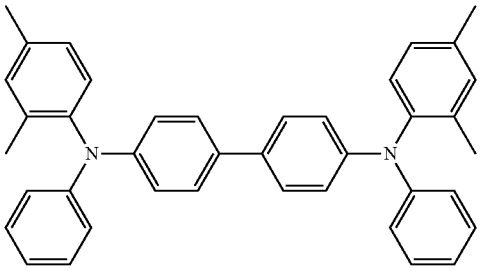

(HT-3)

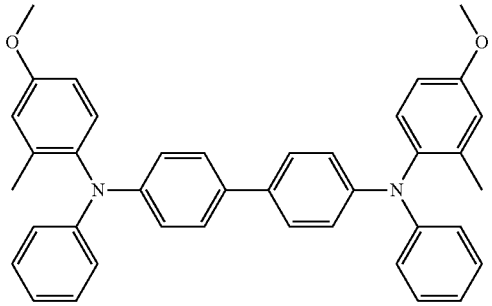

3. The positively chargeable single-layer electrophotographic photosensitive member according to claim 1, wherein a reduction potential of the electron accepting compound is no less than −0.8 V versus a reference electrode ($Ag/Ag^+$).

4. The positively chargeable single-layer electrophotographic photosensitive member according to claim 1, wherein the photosensitive layer further contains a binder resin, and the electron accepting compound is contained in an amount of no less than 10 parts by mass and no greater than 30 parts by mass relative to 100 parts by mass of the binder resin.

5. The positively chargeable single-layer electrophotographic photosensitive member according to claim 1, wherein the charge generating material is metal-free phthalocyanine.

6. A process cartridge comprising the positively chargeable single-layer electrophotographic photosensitive member according to claim 1.

7. An image forming apparatus comprising:

an image bearing member;

a charging section configured to charge a surface of the image bearing member;

a light exposure section configured to expose the surface of the image bearing member in a charged state to light to form an electrostatic latent image on the surface of the image bearing member;

a developing section configured to develop the electrostatic latent image into a toner image; and a transfer section configured to transfer the toner image from the image bearing member to a transfer target, wherein the charging section has a positive charging polarity, and the image bearing member is the positively chargeable single-layer electrophotographic photosensitive member according to claim 1.

8. The positively chargeable single-layer electrophotographic photosensitive member according to claim 1, wherein the compound represented by the general formula (4) is a compound represented by chemical formula (ET-4)

(ET-4)

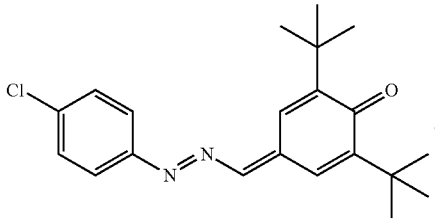

9. The positively chargeable single-layer electrophotographic photosensitive member according to claim 1, wherein the compound represented by the general formula (6) is a compound represented by chemical formula (EA-1) or (EA-2)

(EA-1)

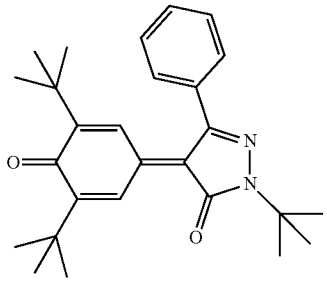

(EA-2)

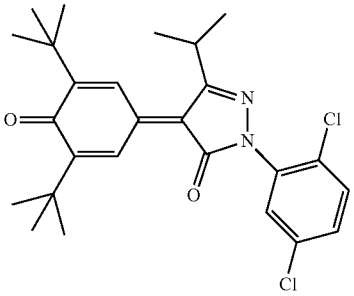

* * * * *